US008985809B2

(12) United States Patent
Bryan et al.

(10) Patent No.: US 8,985,809 B2
(45) **Date of Patent: *Mar. 24, 2015**

(54) DIFFUSION GLOBE LED LIGHTING DEVICE

(71) Applicant: Ecolivegreen Corp., Coral Springs, FL (US)

(72) Inventors: Leonard C Bryan, Palm Beach Gardens, FL (US); Paul L Culler, Tequesta, FL (US)

(73) Assignee: Ecolivegreen Corp., Coral Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/259,297

(22) Filed: Apr. 23, 2014

(65) Prior Publication Data

US 2014/0226341 A1 Aug. 14, 2014

Related U.S. Application Data

(63) Continuation of application No. 13/355,561, filed on Jan. 22, 2012, now Pat. No. 8,733,969.

(51) Int. Cl.
*F21V 7/00* (2006.01)
*F21V 29/00* (2006.01)
(Continued)

(52) U.S. Cl.
CPC ... *F21K 9/50* (2013.01); *F21V 3/02* (2013.01); *F21V 3/0445* (2013.01);
(Continued)

(58) Field of Classification Search
CPC ..... F21K 9/135; F21K 9/54; F21K 9/56; F21S 8/00–8/03; F21V 29/22; F21V 3/02; F21V 3/0445; F21Y 2101/02; F21Y 2105/001
USPC ..... 362/235, 236, 246
See application file for complete search history.

(56) References Cited

U.S. PATENT DOCUMENTS

D263,761 S 4/1982 Glassman
D267,900 S 2/1983 Ishii
(Continued)

FOREIGN PATENT DOCUMENTS

CN 201293256 Y 8/2009
WO 2011129848 A1 10/2011
(Continued)

OTHER PUBLICATIONS

Satco G25 LED Lights, accessed on the internet at: http://www.greenelectricalsupply.com/satco-g25-led-lights-g25-globe-led-light-bulbs-s8783.aspx.
(Continued)

*Primary Examiner* — Sikha Roy
(74) *Attorney, Agent, or Firm* — Stone Creek Services LLC; Alan M Flum

(57) ABSTRACT

Disclosed is a lighting fixture that provides approximately even illumination across a planar surface. Also enclosed is an LED light for producing the same. In one embodiment, the light fixture includes a plurality of hollow gradient diffusion globes; each diffusion globe is affixed to a planar reflector that forms an outer illumination surface of the light fixture. Each diffusion globe surrounds a light-emitting portion of an LED or LED cluster. The hollow gradient diffusion globe can include a wall defining by the interior and exterior boundary of the diffusion globe. The wall includes diffusing-particulate homogenously distributed within the wall that in combination with varying thickness of the wall creates continuously varying diffusion. The relative spacing of the diffusion globes on the planar reflective surface in combination with the continuous variable diffusion property of each globe produce approximately even illumination across the outer illumination surface of the LED light fixture.

2 Claims, 24 Drawing Sheets

(51) Int. Cl.

| | |
|---|---|
| ***F21K 99/00*** | (2010.01) |
| ***F21V 3/02*** | (2006.01) |
| ***F21V 3/04*** | (2006.01) |
| ***F21S 8/00*** | (2006.01) |
| ***F21V 7/05*** | (2006.01) |
| *F21Y 101/02* | (2006.01) |
| *F21Y 105/00* | (2006.01) |

(52) U.S. Cl.

CPC ..... *F21Y 2101/02* (2013.01); *F21Y 2105/001* (2013.01); *F21K 9/135* (2013.01); *F21K 9/56* (2013.01); *F21S 8/03* (2013.01); *F21V 7/05* (2013.01); *F21V 29/70* (2013.01)

USPC ..... 362/235; 362/237; 362/240; 362/243; 257/88; 257/98

(56) References Cited

U.S. PATENT DOCUMENTS

| | | | | |
|---|---|---|---|---|
| 5,836,676 | A * | 11/1998 | Ando et al. | 362/244 |
| 6,305,821 | B1 * | 10/2001 | Hsieh et al. | 362/246 |
| 6,364,502 | B1 | 4/2002 | Johnson | |
| D469,561 | S | 1/2003 | Thompson | |
| 6,764,196 | B2 | 7/2004 | Bailey | |
| 6,788,541 | B1 * | 9/2004 | Hsiung | 361/719 |
| 7,114,831 | B2 | 10/2006 | Popovich et al. | |
| 7,607,790 | B2 * | 10/2009 | Chen et al. | 362/97.1 |
| 7,645,052 | B2 | 1/2010 | Villard | |
| 7,648,257 | B2 | 1/2010 | Villard | |
| 7,745,769 | B2 | 6/2010 | Tracy et al. | |
| D620,174 | S | 7/2010 | Sabernig | |
| 7,794,114 | B2 | 9/2010 | Medendorp, Jr. | |
| 7,976,194 | B2 * | 7/2011 | Wilcox et al. | 362/268 |
| 2005/0105302 | A1 | 5/2005 | Hofmann et al. | |
| 2006/0187660 | A1 | 8/2006 | Liu | |
| 2007/0075306 | A1 * | 4/2007 | Hayashi et al. | 257/13 |
| 2008/0266869 | A1 * | 10/2008 | Tai et al. | 362/294 |
| 2008/0308825 | A1 | 12/2008 | Chakraborty et al. | |
| 2009/0141494 | A1 * | 6/2009 | Zhang et al. | 362/249.03 |
| 2009/0196045 | A1 | 8/2009 | Shuai et al. | |
| 2009/0323334 | A1 | 12/2009 | Roberts et al. | |
| 2010/0110661 | A1 | 5/2010 | Park | |
| 2010/0172127 | A1 | 7/2010 | Tracy et al. | |
| 2010/0177522 | A1 | 7/2010 | Lee | |
| 2010/0328925 | A1 * | 12/2010 | Hoelen et al. | 362/84 |
| 2011/0001151 | A1 | 1/2011 | Le Toquin | |
| 2011/0001422 | A1 * | 1/2011 | Aanegola et al. | 313/501 |
| 2011/0069496 | A1 | 3/2011 | Ing et al. | |
| 2011/0075408 | A1 | 3/2011 | Negley et al. | |
| 2011/0080740 | A1 | 4/2011 | Allen et al. | |
| 2011/0080742 | A1 | 4/2011 | Allen et al. | |
| 2011/0298355 | A1 | 12/2011 | van de Ven | |
| 2013/0003373 | A1 * | 1/2013 | Hamby et al. | 362/249.02 |

FOREIGN PATENT DOCUMENTS

| | | | |
|---|---|---|---|
| WO | 2011156230 | A2 | 12/2011 |
| WO | 2013056516 | A1 | 4/2013 |

OTHER PUBLICATIONS

Panasonic Unveiled "Everleds" Series LED Lights, LEDinside, Jan. 31, 2011, accessed on the internet at: http://www.ledinside.com/print/12815.

Hawkins, LED Enlarger Head, Jun. 19, 2010, accessed on the internet at http://www.rwhawkins.com/wordpress/archives/99.

Ping Pong Ball LED Diffuser, Feb. 21, 2008, accessed on the internet at http://www.uchobby.com/index.php/2008/02/21/ping-pong-ball-led-diffuser/.

Indoor Light Fixture Grow System 360 Watt Hydroponic, accessed on the internet at: http://pt.ioffer.com/i/indoor-light-fixture-grow-system-360-watt-hydroponic-132463667.

Optical Solutions for OEM Applications, LSD Light Shaping Diffusers, Date of Publication: 2001, Physical Optics Corporation, Torrance, CA US.

LED Luminaire Design Guide, Date of Publication: 2007, p. 7, Cree Inc., Durham, NC US.

Cree X-Lamp MC-E LED Datasheet, p. 5, Date of Publication: 2009, Cree Inc., Durham, NC US.

Bridgelux LED Arrays Product Datasheet DS10, p. 11, May 10, 2010, Bridgelux inc., Livermore CA, US.

Arnold Wilkins, "Light Right for Sight: Health and Efficiency in Lighting Practice", IAEEL Light Right Proceedings: A. Technology and Light Quality, pp. 57-61, International Association for Energy-Efficient Lighting (IAEEL), Stockholm, SE 1991.

Cree XLamp XP-G LED Datasheet, p. 10, Date of Publication: 2011, Cree Inc., Durham, NC US.

DuPont Diffuse Light Reflector, pp. 1-2, May 2008, E.I. du Pont de Nemours and Company, Wilmington, DE.

Gore Diffuse Reflector Product, pp. 1-2, Oct. 1, 2010, W.L. Gore and Associates, Newark, DE.

3M Engineering Grade and Utility Grade Reflective Sheeting, Product Bulletin 3200, pp. 1-3, Sep. 2011, 3M, St. Paul, MN.

Avery Dennison M-0500 Series Commercial Grade Beaded Retroreflective Film, Revision 1, Apr. 2011, pp. 1-4, Avery Dennison, Painesville, OH.

Ansems et al., "Scattering Outer Dome With Varying Wall Thickness", U.S Appl. No. 61/548,882, filed Oct. 19, 2011, United States Patent and Trademark Office, Published on WIPO Patent Scope on Apr. 25, 2013, downloaded from the Internet at http://patentscope.wipo.int/search/en/detail.jsf?docId=WO2013056516 on Jan. 11, 2014.

Ansems et al. "Scattering Outer Dome With Varying Wall Thickness", Application Body as Filed for PCT Application No. PCT/CN/2012001405 for publication WO 2013056515A1, published on WIPO Patent Scope on Apr. 25, 2013, downloaded from the Internet at http://patentscope.wipo.int/search/en/detail.jsf?docId=WO2013056516 on Jan. 11, 2014.

Non-Final Office Action, U.S. Appl. No. 13/355,561, Bryan et al., Date of Action: Nov. 21, 2013, United States Patent and Trademark Office, Alexandria VA.

Examiner-Initiated Interview Summary, U.S. Appl. No. 13/355,561, Bryan et al., Date of Document: Feb. 20, 2014, United States Patent and Trademark Office, Alexandria VA.

* cited by examiner

DIFFUSION GLOBE LED LIGHTING DEVICE

CROSS-REFERENCE TO RELATED APPLICATIONS

This application is a continuation of U.S. patent application Ser. No. 13/355,561 filed on Jan. 22, 2012, the contents of which are hereby incorporated by reference.

BACKGROUND

The present disclosure relates to a light fixture that uses light emitting diodes (LEDs) as light sources. Specifically, the disclosure relates to LED illuminated lighting fixtures that can be mounted on a ceiling, wall, or dropped into a drop ceiling frame.

Lighting fixtures with LED light sources are being used to replace conventional commercial fluorescent ceiling and wall mounted light fixtures because they can potentially have several desirable characteristics such as higher efficiency, more pleasing light quality, and longer light-source life.

LED ceiling and wall mounted lighting fixtures designers face several potential challenges as compared with fluorescent ceiling lighting fixtures. For example, most LEDs are point sources of light making it challenging to create even illumination. Further, direct viewing of bright, or so-called "high-brightness" LEDs can potentially cause eye damage. In addition, many commercially available high efficiency white LEDs utilize a near ultra-violet LED with a phosphor coating that can include, for example, europium plus copper and aluminum-doped zinc sulfide so that the light appears white. Direct viewing of ultra-violet (UV) light leaked from phosphor-coated LEDs can also be a potential source of eye damage.

Another potential challenge LED wall and ceiling mounted fixtures face compared to fluorescent wall and ceiling light fixtures is that unlike fluorescent bulbs that dissipate heat across their glass envelope, LED dissipate heat mostly through their non-illuminating bottom surface.

In addition, LED ceiling light fixtures that are designed to replace fluorescent ceiling troffers or as drop-in fluorescent ceiling tile replacements are often difficult to service. In many cases, the entire fixture needs to be removed from the ceiling for servicing.

Attempts to address the problem of potential eye damage or eyestrain include, for example, indirect LED lighting fixtures. However, depending on the specifics of the design, indirect LED lighting fixtures can cast a shadow or otherwise have a visual dark spot where the light source is blocked. In some applications, this may be undesirable. Attempts to make LED ceiling light fixtures that are designed to replace fluorescent ceiling troffers or as drop-in fluorescent ceiling tile replacements more serviceable include LED replacement lights in the form factor of a fluorescent replacement tubes. While these are often satisfactory in some residential or commercial settings, they may not be appropriate for circumstances requiring certain aesthetics or specific form factors.

It would therefore be desirable for there to be an LED lighting fixture that attempts to address at least some of the above-mentioned challenges.

SUMMARY

This Summary introduces a selection of concepts in simplified form that are described in the Description. The Summary is not intended to identify essential features or limit the scope of the claimed subject matter.

One aspect of the present disclosure describes an LED lighting fixture that provides approximately even illumination across the outer illumination surface of the light fixture. Another aspect of the invention describes an LED light for producing the same.

In the first aspect, a light emitting diode (LED) lighting fixture includes a plurality of hollow gradient diffusion globes, a plurality of LED clusters, and a planar reflective sheet. Each gradient diffusion globe includes a hollow cover including an aperture, a wall bound by an exterior surface having the shape of a globe, the wall of varying thickness with a thickest wall portion opposite the aperture, a diffusing-particulate homogenously distributed within the wall, and the wall and the diffusing-particulate in combination form a continuously graduated diffusive surface. The gradient diffusion globe can also include a hollow base portion surrounding the aperture and projecting outward from the hollow cover. Each LED cluster positioned within a corresponding gradient diffusion globe of the plurality of gradient diffusion globes, the LED cluster including a top surface facing and normal to the thickest wall portion. The planar reflective sheet forms an outer illumination surface of the light fixture, the planar reflective surface including a plurality of apertures, each aperture receiving therethrough a corresponding base portion. The apertures arranged so that the plurality of gradient diffusion globes, the plurality of LED clusters, and the planar reflective surface in combination produce substantially uniform illumination along the outer illumination surface of the light fixture.

In the later aspect, an LED lamp, includes a hollow cover that includes an aperture, a wall bound by an exterior surface having the shape of a globe, the wall of varying thickness with a thickest wall portion opposite the aperture, a diffusing-particulate homogenously distributed within the wall, and the wall and the diffusing-particulate in combination form a continuously graduated diffusive surface. In addition, an LED is positioned within the globe cover, the LED including a top LED surface facing and normal to the thickest wall portion.

In yet another aspect, a light emitting diode (LED) lighting fixture includes a plurality of hollow diffusion globes, a plurality of LED clusters, a planar reflective sheet, a backplane, and a plurality of retaining rings. The plurality of retaining rings, the plurality diffusion globes, and the planar reflective sheet form a first assembly. The plurality of LED clusters and backplane form a second assembly. The first assembly is separable from the second assembly.

In this aspect, each diffusion globe includes a hollow cover including an aperture and a hollow base portion surrounding the aperture and projecting outward from the hollow cover. Each of LED cluster of the plurality of LED clusters is positioned within a corresponding diffusion globe. The planar reflective sheet forms an outer illumination surface of the light fixture. The planar reflective surface includes a plurality of apertures, each aperture receiving therethrough a corresponding base portion. The apertures arranged in a grid pattern. The backplane, which is separate from and parallel to the planar reflective sheet, forms a continuous planar heat sink and defines a bottom outer surface of the light fixture. Each LED cluster can be thermally and mechanically coupled to the backplane. Each retaining ring receives and secures a corresponding base portion to the planar reflective sheet.

DRAWINGS

DESCRIPTION

Figure 1:
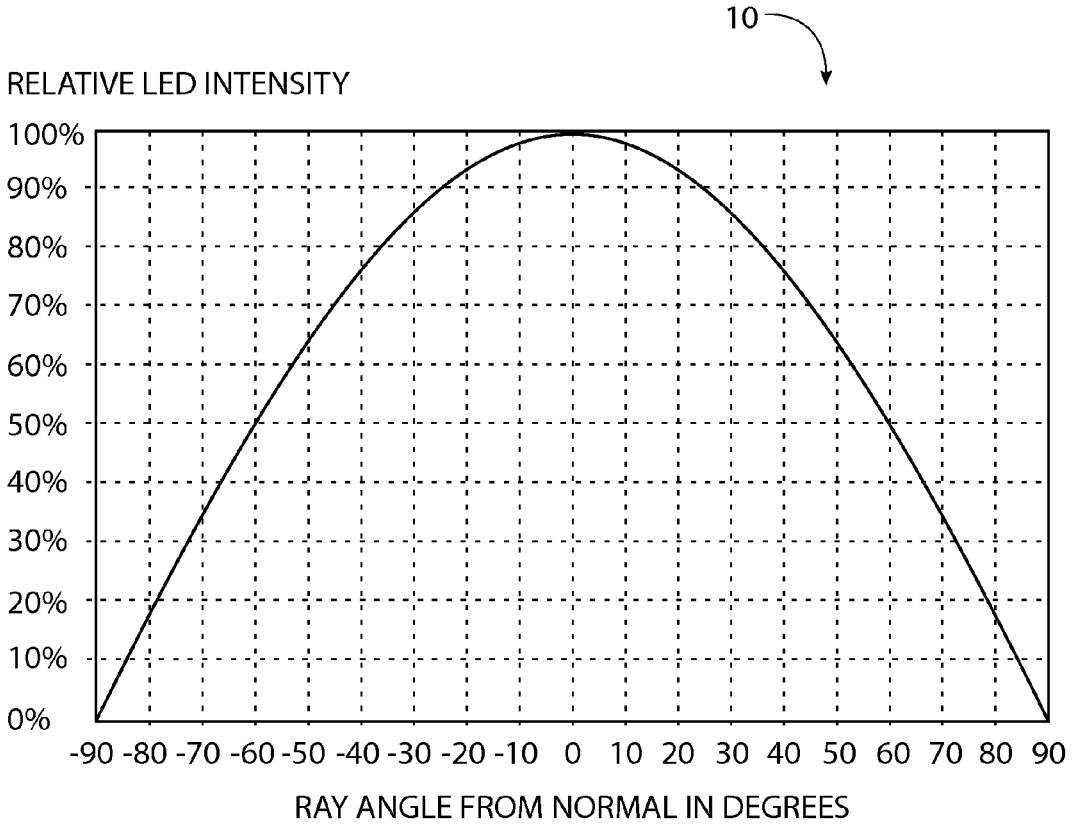
FIG. 1 PRIOR ART
FIG. 1 depicts a relative LED light intensity versus viewing angle for an exemplary LEDs and LED arrays in the prior art.

The following description is made with reference to figures, where like numerals refer to like elements throughout the several views. FIG. 1 depicts a graph 10 of relative LED light intensity in percent (vertical axis) versus viewing angle in degrees (horizontal axis) for an exemplary LEDs and LED clusters in the prior art. LEDs typically have a top surface and a heat dissipating bottom surface. The graph 10 depicts the percent of maximum intensity where 0-degrees is normal to top surface and +90 degrees and −90 degrees are parallel to the mounting plane of the LED. The graph 10 depicts an exemplary LED or LED cluster with maximum intensity on axis or normal to the top surface of the LED with intensity falling off from the normal in a bell shaped or semi-parabolic shaped curve.

As used throughout this disclosure, an LED cluster means one or more LEDs configured to act as a point source of light. For example, an LED cluster can mean a single LED such as a Cree XLamp XP-G, a multi-chip LED such as a Cree XLamp MC-E or BridgeLux BRXA series LEDs, or a plurality of LEDs clustered together to act as a point source. The above-mentioned LEDs are exemplary and are not meant to limit the meaning of LED Cluster to those particular models and manufacturers.

The characteristic of the LEDs and LED clusters exemplified in FIG. 1 makes it difficult to obtain uniform illumination, or uniform luminous flux density, across the surface of a planar light fixture from the direct illumination of LED clusters, especially when the LED clusters are spaced a distance larger than many times the diameter of the LED clusters, for example, at a distance of over five times the diameter of each LED cluster.

Figure 2:
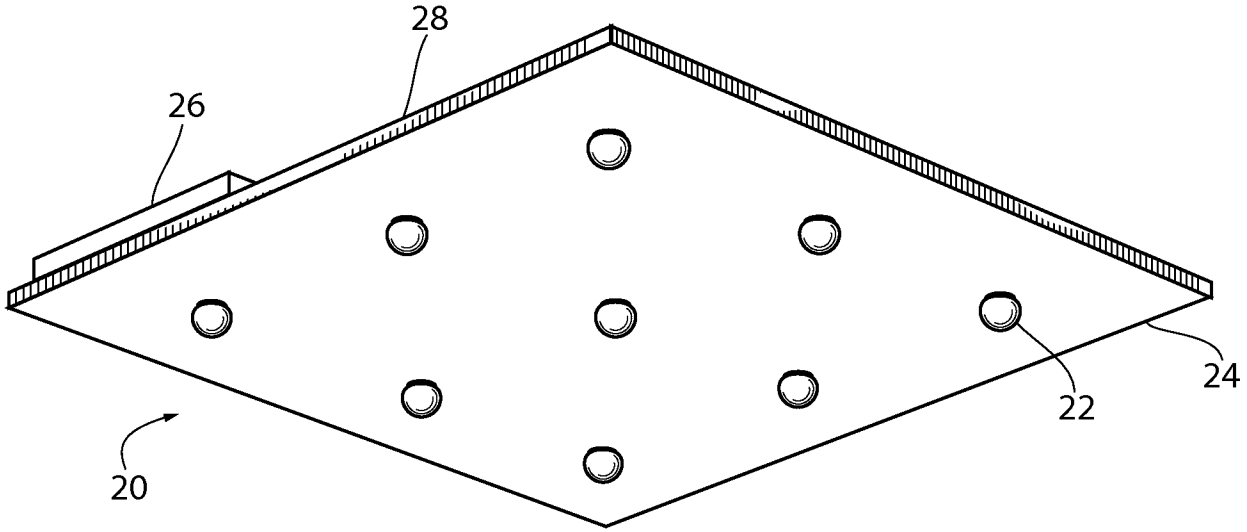
FIG. 2 depicts a bottom perspective view a light fixture according to an embodiment in accordance with the present invention.

FIG. 2 depicts a bottom perspective view an LED lighting fixture 20 of an embodiment in accordance with the present invention illustrating a lighting fixture capable of conveying nearly uniform illumination across the surface of a planar light fixture with LED clusters spaced at a distance many times the diameter of each LED cluster. Each LED cluster is surrounded by hollow gradient diffusion globe 22, the exterior surface having the shape of a globe. Each hollow gradient diffusion globe 22 is affixed to a planar reflective sheet 24. The planar reflective sheet 24 forms an outer illumination surface of the LED lighting fixture 20.

As defined in this disclosure, a planar reflective sheet 24 includes a top reflective, diffusive, or combination reflective and diffusive surface, and can optionally include a bottom surface that forms an electrically non-conductive electrically insulative barrier. For example, the top surface can be coated with a diffuse-reflective white paint or powder coat finish that has both diffusive and reflective properties. In addition, a reflective planar sheet can be have a top surface with aluminum anodized finished or an anodized brushed aluminum finish and may be painted white or left unpainted and can include a non-conductive backing such as ABS, polyethylene, polypropylene, or polyester. The planar reflective surface can have a sheeting material applied to a rigid or semi-rigid backing The sheeting material can comprise glass beads enclosed in a translucent pigmented substrate, for example, Scotchlite Engineer Grade 3200 series by 3M, or M-0500 or W-0500 series by Avery Denison. The semi-rigid backing can be constructed from an electrically non-conductive material to prevent electrical shorting or interference with the operation of the LEDs. The planar reflective sheet can be constructed from other diffuse reflective material; for example, Gore Diffuse Reflector Product, or Dupont Diffuse Light Reflector (DLR). These examples are meant to be illustrious and not meant to limit the meaning of a planar reflective sheet, those skilled in the art may readily recognize other equivalents from these examples. In order to form a continuous illumination surface, the reflective sheet can be continuous and seamless.

In the illustrated embodiment of FIG. 2, a power and electronics assembly 26 supplies power to LEDs. In one embodiment, the power and electronics assembly 26 can include a DC-to-DC power supply capable of receiving distributed DC voltage into the light fixture. In an alternative embodiment, the power and electronics assembly 26 can include an AC-to-DC power supply capable of receiving standard line voltage, for example 120 VAC in the United States, from a commercial or residential branch circuit and converting it to the DC supply voltage capable of powering the LED clusters. The power and electronics assembly 26 can be affixed a backplane 28, the backplane 28 forms a bottom outer surface of the light fixture and can be used as a continuous planar heat sink to dissipate the heat from the LED clusters.

Figure 3:
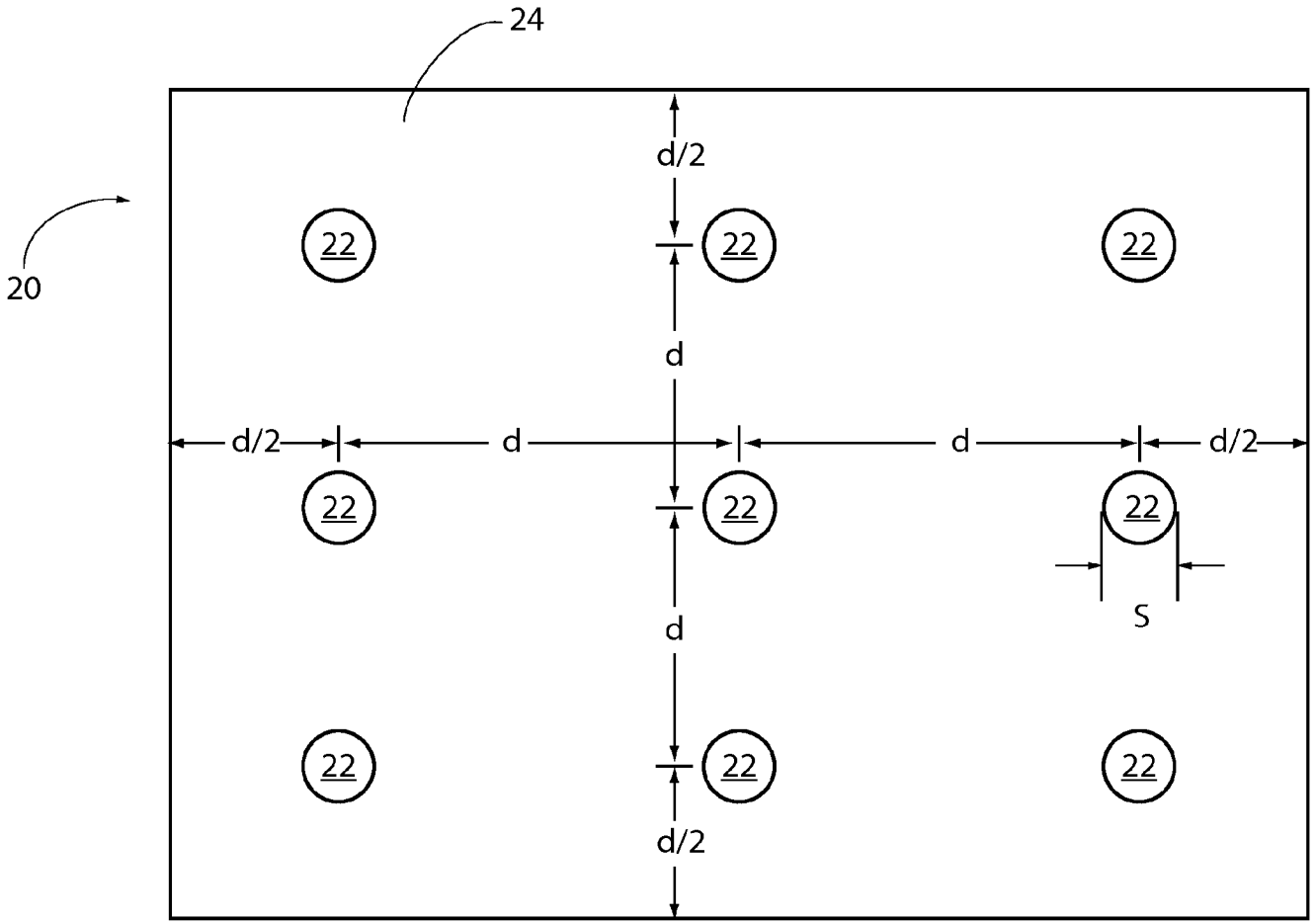
FIG. 3 depicts a top view of embodiment of the lighting fixture of FIG. 2 illustrating exemplary relative spacing of the diffusion globes.

FIG. 3 depicts a top view of embodiment of the LED lighting fixture 20 of FIG. 2 illustrating exemplary relative spacing of the hollow gradient diffusion globes 22, the hollow diffusion globes having a diameter depicted by distance s. In the illustrated embodiment, the hollow gradient diffusion globes 22 are arranged in a grid pattern with each hollow gradient diffusion globe 22 separated from each other by a distance d. The hollow gradient diffusion globes 22 are spaced by a distance d/2 from the perimeter of the planar reflective sheet 24. For example, in accordance with principles of the invention, is should be possible to create nearly uniform lighting for ceiling tile replacement fixture with a 0.61 m (2 ft.)×0.61 m (2 ft.) planar reflective sheet 24, and nine of the hollow gradient diffusion globes 22 each of diameter s=0.038 m (1.5 in.), each hollow gradient diffusion globe 22 spaced by a distance d=0.2 m (8 in.). For example, for a typical multiple LED of diameter 0.02 m (0.8 in.), such as a BridgeLux BRXA-C2000, the LEDs are separated by a distance d=0.2 m (8 in.) that is approximately 10 times the diameter of each LED. Using the same exemplary spacing, a 0.61 m (2 ft.)×1.22 m (4 ft.) ceiling tile replacement lighting fixture can be constructed using eighteen LED clusters, each LED cluster enclosed by corresponding hollow gradient diffusion globe 22. If, for example, each LED cluster comprised three to four closely spaced LEDs such as XP-G series LEDs, with each LED having a mounting edge of 0.00345 m (0.135 in.), then the effective diameter across the LEDs could be as small as approximately 0.01 m (0.394 in.). In this example, a distance d=0.2 m (8 in.) would be approximately twenty times the effective diameter of the LED cluster.

Figure 4:
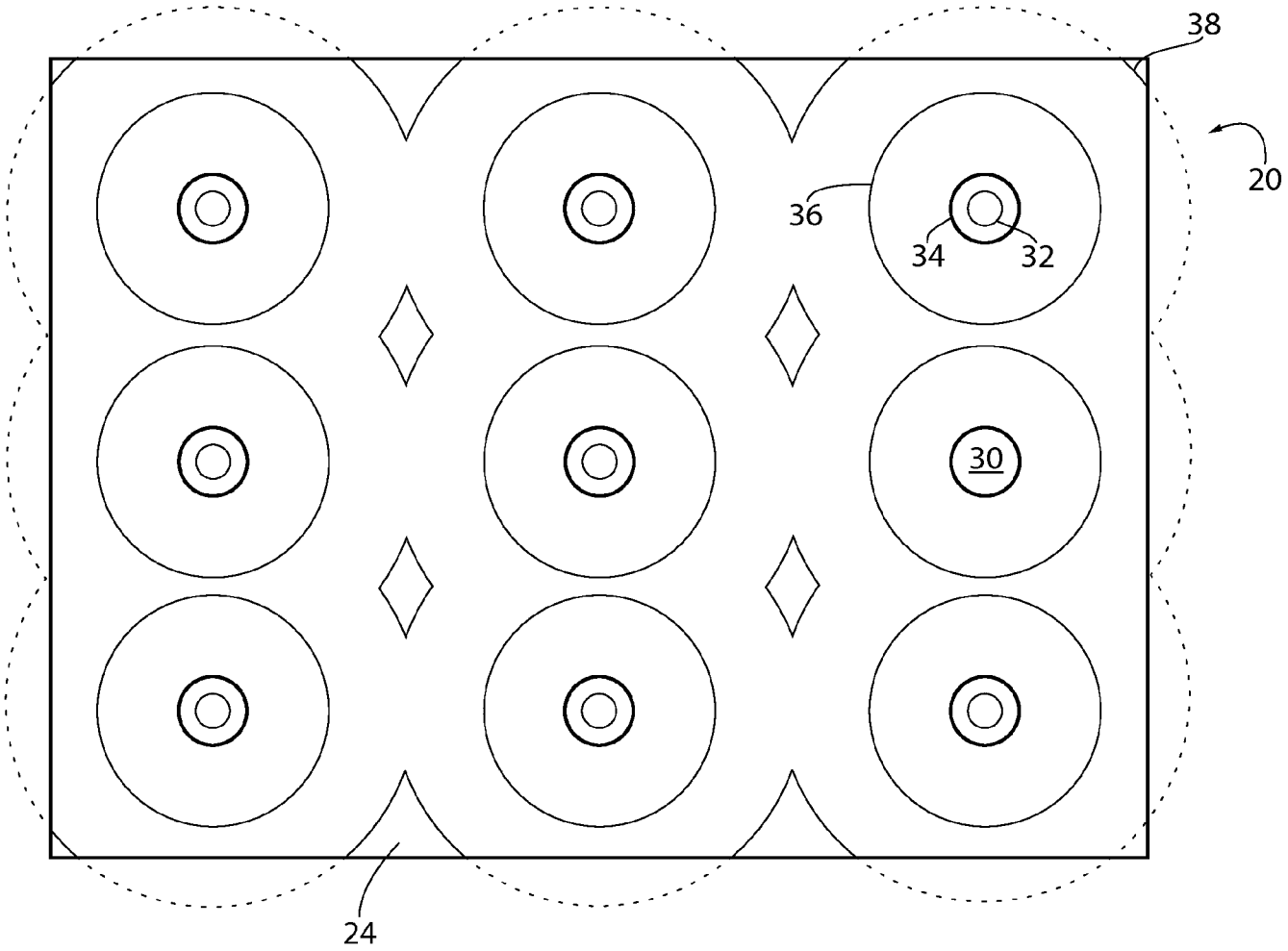
FIG. 4 depicts a light dispersion pattern of the lighting fixture of FIG. 2 where the diffusion globes have a fixed diffusion pattern.

FIG. 4 depicts an exemplary light pattern of the LED lighting fixture 20 with diffuser globes 30 that are non-gradient diffusers. For purposes of illustration, the light pattern radiated from each diffuser globe 30 can be divided into four zones: a central zone 32, the zone within the diffuser globe circumference 34, a first reflection zone 36, and a second reflection zone 38. The central zone 32 represents a hot spot on the diffuser globe 30 and representing the area of highest illuminance. The majority of light appears to be radiating from a combination of the area from within the zone within the diffuser globe circumference 34 and the central zone 32 with most of the rest of the light being reflected or diffused in the first reflection zone 36.

Figure 5:
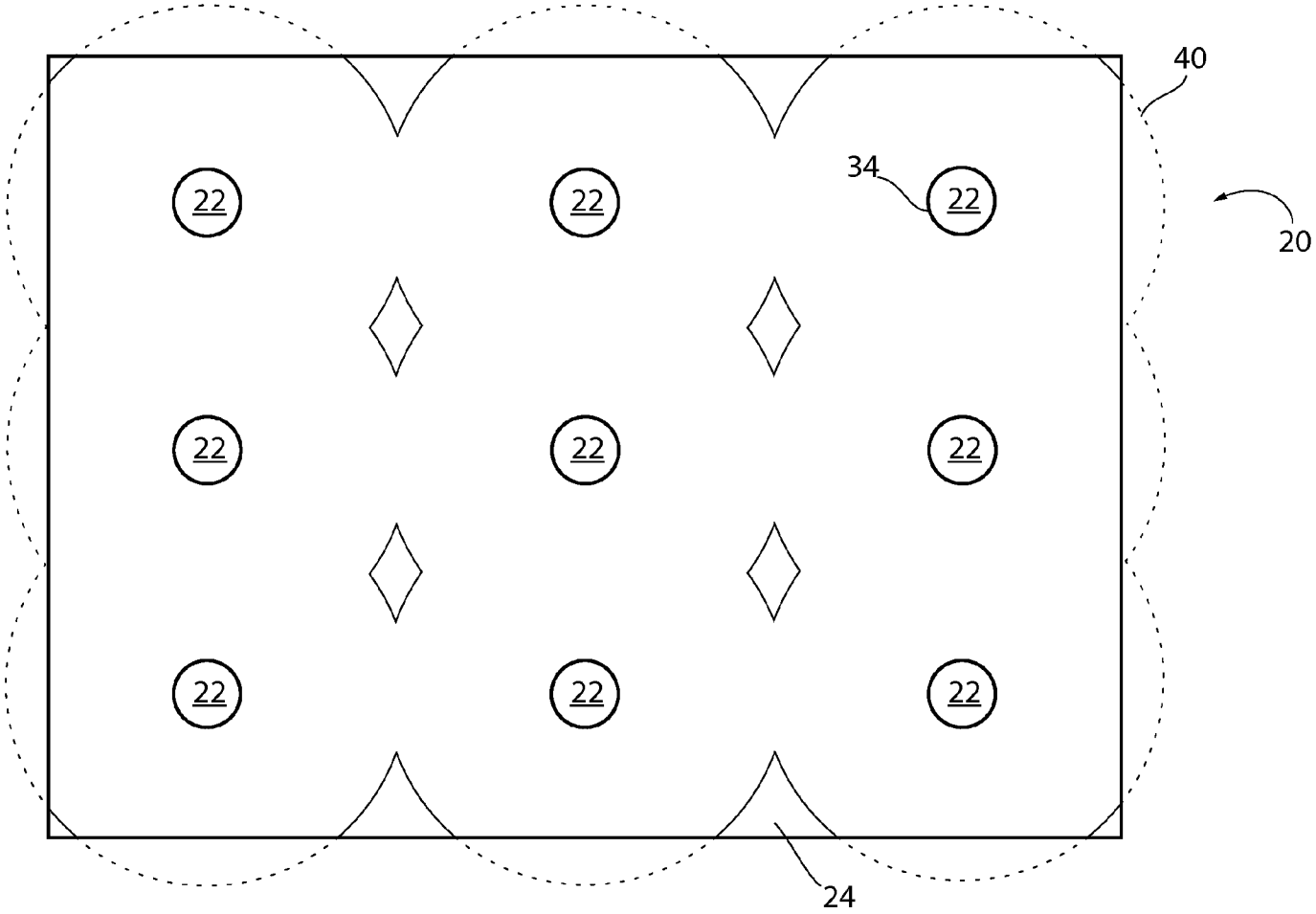
FIG. 5 depicts a light dispersion pattern of the lighting fixture of FIG. 2 where the diffusion globes have a graduated diffusion pattern.

FIG. 5 depicts an exemplary light pattern of the LED lighting fixture 20 with hollow gradient diffusion globes 22. The light pattern can be divided into two zones, the zone within the diffuser globe circumference 34 and an expanded reflection zone 40. The expanded reflection zone 40 approximately encompasses both the first reflection zone 36 and the second reflection zone 38 of FIG. 4. From the plane view perspective of FIG. 5, the luminous flux density of the zone within the diffuser globe circumference 34 and the expanded reflection zone 40 are approximately equal. This creates an overall appearance uniform lighting across the outer illumination surface of the light fixture with virtually no hot spots.

The approximately uniform luminous flux density over the entire surface of the planar reflective sheet 24 is determined by the combination of the illumination pattern of the LED clusters, the light diffusion and illumination pattern of the hollow gradient diffusion globes 22, the distance of separation between each hollow gradient diffusion globe 22, and the reflective and diffusive characteristic of the planar reflective sheet 24. The characteristics of LEDs and LED clusters used for commercial and residential lighting applications is well known, for example, as in the lighting curve of FIG. 1, and is generally published by LED lighting manufacturers.

Another consideration is heat dissipation. It may be desirable to provide adequate heat dissipation distance across the backplane 28 of FIG. 2 without the need of any additional heat sinks. The life expectancy of an LED is typically related to the LED operating temperature or more specifically to the LED junction temperature. Many LED or LED clusters dissipate the majority of the heat through their bottom surface. Depending on the LED design and manufacturer, the lighting system designer can be faced with different heat dissipation strategies. For example, BridgeLux, provides LED arrays, such as the BRLX-C series, that are designed to screw directly into a heat dissipating surface. They have a large non-conductive heat dissipation contact point on the bottom surface and have solder points for the LED's electrical connections (anode and cathode) on the upper surface. Cree LED arrays, such as the MC-E series, have both electrical connection and non-conductive heat dissipation contact on the bottom of the LED array. The Cree recommends having solid copper traces (vias) going through the PCB in order to dissipate the heat. Regardless of the method, the LED arrays can be thermally and mechanically coupled to the backplane 28, such that, the backplane acts as a heat-dissipating surface.

One of the considerations in disclosed lighting system is spacing the LED clusters to obtain approximately uniform lighting across the entire surface of the planar reflective sheet 24 while at the same time providing adequate spacing between the LED clusters to keep the junction temperatures of the LED clusters well within the recommended manufacturer's specifications. Those skilled in the art will readily recognize how to calculate using thermal modeling or by using simulation tools such as National Semiconductor Workbench LED Architect, Luxeon Star LED heatsink calculator without undue experimentation. Once the heat dissipation requirement for each LED cluster is known, and the area of the backplane required to dissipate the requirement amount of heat is calculated, the hollow gradient diffusion globe 22 construction can be chosen so that the LED clusters are spaced to obtain approximately uniform lighting across the entire surface of the planar reflective sheet 24 and provide adequate area from the each of the LED clusters to dissipate the requirement amount of heat.

Figure 6:
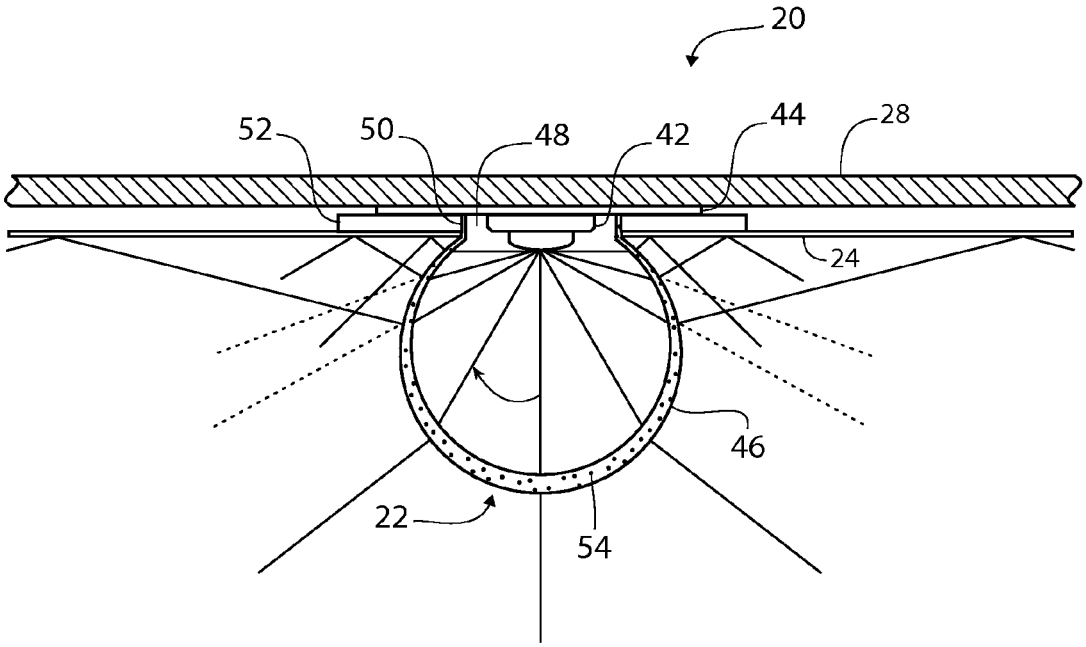
FIG. 6 depicts a sectional view of a portion of the LED lighting fixture of FIG. 2, showing an embodiment of a globe diffuser and the resulting ray trace diagram.

FIG. 6 depicts a sectional view of a portion of the LED lighting fixture 20 of FIG. 2, showing an embodiment of the hollow gradient diffusion globe 22 and the resulting ray trace diagram. LED cluster 42 is illustrated for the sake of simplicity as a single LED. However, in addition to a single LED, it should be understood that this can include two or more LEDs physically clustered closely together to act as a single point source. The LED cluster 42 is mounted to a printed circuit board (PCB) 44. The LED cluster 42 is both thermally and physically coupled to the backplane 28 either through the PCB 44 or directly, for example if the LED is manufactured with a non-conductive thermal pad. The hollow gradient diffusion globe 22 includes a the hollow cover portion 46 receiving the LED cluster 42 through an aperture 48 and a hollow base portion 50 projecting outward from hollow cover portion 46 and surrounding the aperture 48. The planar reflective sheet 24 includes an aperture for receiving the hollow base portion 50. The hollow base portion 50 can be secured to the planar reflective sheet 24, for example, by a retaining ring 52.

The hollow cover portion 46 includes a wall bound by the exterior surface of the hollow cover portion 46. The exterior surface of the wall has the shape of a globe. As defined in this disclosure a globe means a shape approximating a spheroid. A spheroid can include a sphere, an oblate spheroid or a prolate spheroid. Hollow gradient diffusion globes 22 can be injection molded or otherwise formed from a semi-transparent or translucent plastic material such as acrylonitrile butadiene styrene (ABS), polyacrylate (acrylic plastic), polycarbonate, or polyvinyl chloride (PVC). A diffusing-particulate 54 is homogenously distributed within the wall. The particulate is made of a material that has a light scattering effect when encapsulated within clear or translucent plastic, for example Titanium Dioxide, Zinc Oxide, or metallic particulates. A continuously graduated diffusive wall is created by the combination of diffusing-particulate 54 homogenously distributed within the wall, and by smoothly and continuously varying the thickness of the wall.

It may be desirable, for reasons already disclosed, to filter UV light from reaching the eye of an observer. Embedding UV light filtering material in the plastic or by alternatively coating the hollow gradient diffusion globe 22 with UV filtering material may facilitate the filtering of UV light.

The wall bounding the interior surface has approximately the same shape as the wall bounding the exterior surface but with a smaller radius. The interior surface is approximately axial to and non-concentric with the exterior surface. This arrangement creates a wall thickness that is thickest opposite the aperture 48 and the LED cluster 42, progressively and smoothly thinning where the thinnest portions are adjacent to the LED cluster 42. The great amount of diffusion and most random internal reflection take place where the wall is thickest since there is the most diffusing particulate. The least amount of diffusion and least internal reflection take place where the wall is the thinnest. With this arrangement, harsh direct light from the LED cluster 42 is attenuated and the overall illumination across can be made to be equal across the entire lighting fixture illumination surface.

Continuing to refer to FIG. 6, an illustrative ray trace diagram shows a typical light pattern emanating from the LED cluster 42. A portion of the rays are diffused externally with respect to the hollow cover portion 46 and are represented by rays normal to the hollow cover portion 46. Some of the rays are refracted and are illustrated by broken lines. Some of the rays are internally reflected by not shown for simplicity. Greater amounts of internal reflection come from the regions of greatest diffusion as compared with areas of less diffusion. For example, greater amount of internal reflection would occur where the wall of the hollow cover portion 46 is the thickest near the top of the globe, opposite the LED cluster 42 as compared to portions of hollow cover portion 46 adjacent to the LED. The area of greatest refraction, least diffusion, and least internal reflection occur where the wall of the hollow cover portion 46 is the thinnest which is adjacent to the LED cluster 42.

The arrangement, shape and size of the inner wall with respect to the outer wall of the hollow cover portion 46 depicted in FIG. 6 can potentially create an approximately complementary light emission pattern as the relative intensity pattern of FIG. 1, this in combination with the internal reflection, and diffusion, creates the appearance of even lighting across the hollow gradient diffusion globe 22. The combination of the ray emission pattern from the hollow gradient diffusion globe 22, the reflection from the planar reflective sheet 24, and the spacing between the hollow gradient diffusion globes 22, creates the appearance of uniform lighting across the entire an outer illumination surface of the light fixture.

Figure 7:
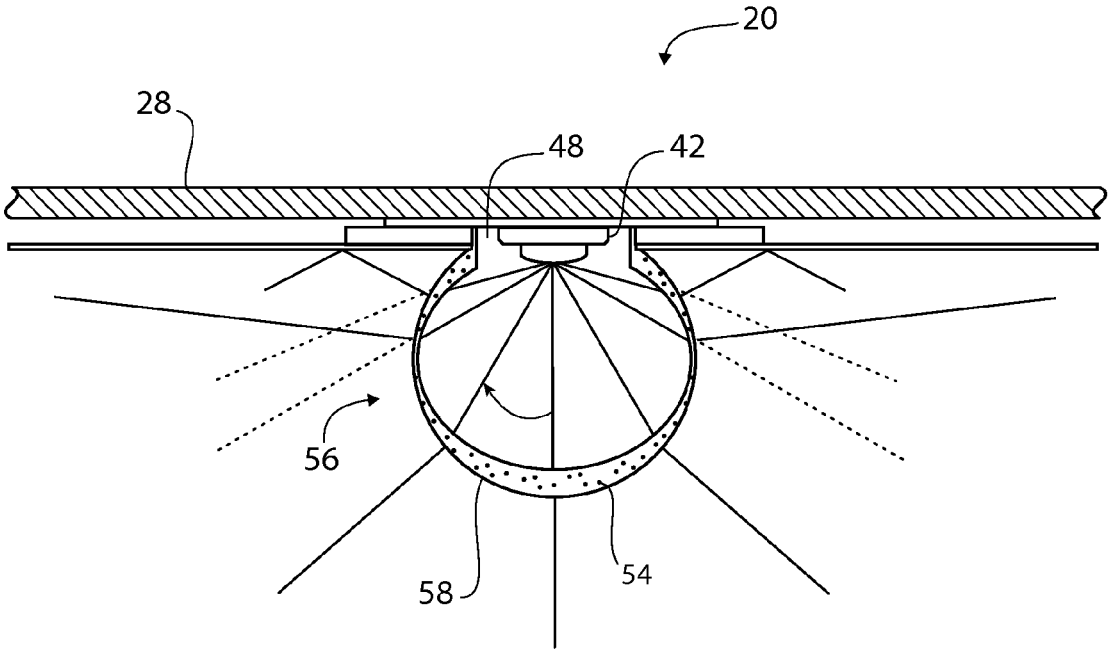
FIG. 7 depicts a sectional view of a portion of the LED lighting fixture of FIG. 2, showing an alternate embodiment of a globe diffuser and the resulting ray trace diagram.

FIG. 7 depicts a sectional view of a portion of the LED lighting fixture 20 of FIG. 2, showing an alternate embodiment of a hollow gradient diffusion globe 56 and the resulting ray trace diagram. The hollow cover portion 58 includes wall bound by the exterior surface of the hollow cover portion 58. In FIG. 7, the exterior surface of the wall has the shape of a sphere. A diffusing-particulate 54 is homogenously distributed within the wall. The particulate is made of a material that has a light scattering effect when encapsulated within clear or translucent plastic, as previously described. The wall bounding the interior surface is an oblate spheroid. The interior surface is approximately axial to and non-concentric with the exterior surface. This arrangement creates a wall thickness that is thickest opposite the aperture 48 and the LED cluster 42, progressively and smoothly thinning where the thinnest portion along the circumference between the upper and lower hemisphere of the hollow cover portion 58. The great amount of diffusion and most random internal reflection take place where the wall is thickest since there is the most diffusing particulate. The least amount of diffusion and least internal reflection take place where the wall is the thinnest. With this arrangement, harsh direct light from the LED cluster 42 is attenuated. The overall illumination across can be made to be equal across the entire lighting fixture illumination surface with the relative distance between each hollow gradient diffusion globe 56 being further than with the hollow gradient diffusion globe 22 of FIG. 6.

Figure 8:
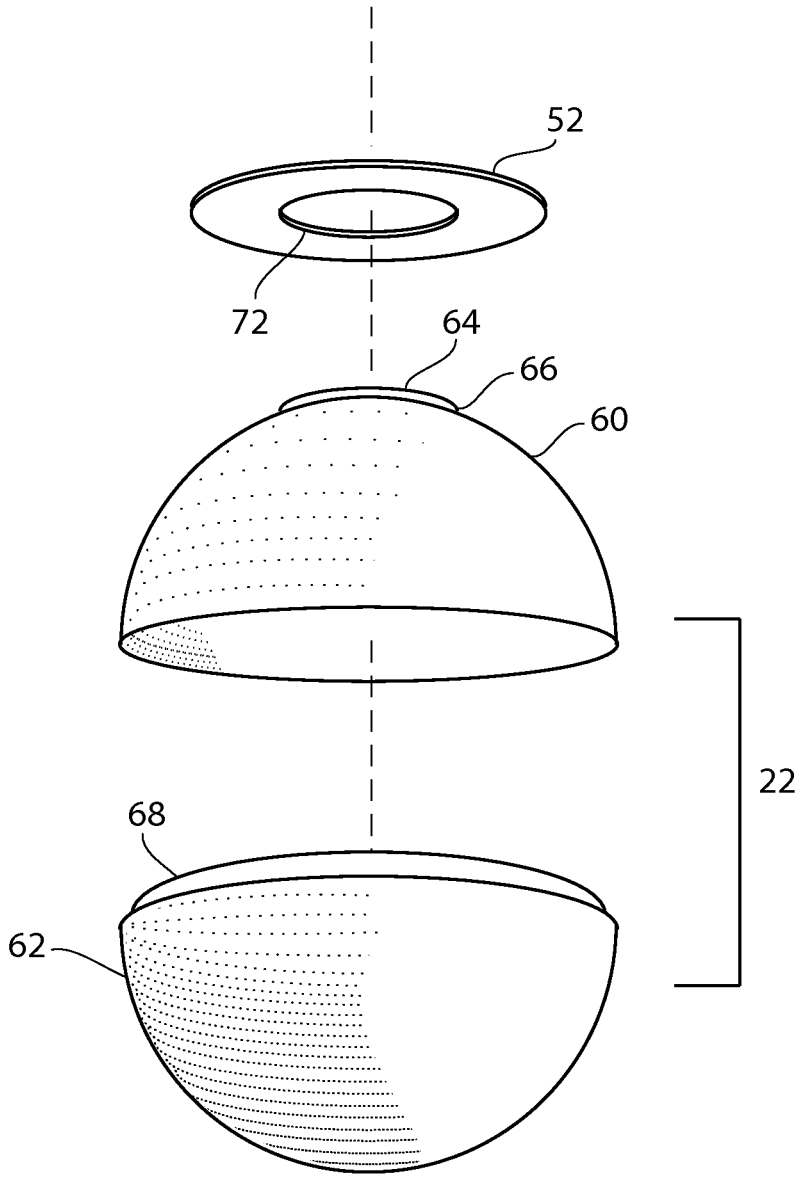
FIG. 8 depicts a perspective view of an embodiment of a globe diffuser and ring assembly in accordance with principles of the invention.

FIG. 8 depicts a bottom perspective view of an embodiment of the hollow gradient diffusion globe 22 and ring assembly in accordance with principles of the invention. In order to help facilitate manufacturing of the hollow gradient diffusion globe 22, for example by injection molding, the hollow gradient diffusion globe 22 can be molded, or otherwise formed in two hemispheres: an upper hemisphere 60 and a lower hemisphere 62. The upper hemisphere 60 includes an aperture 64 and a base portion 66 surrounding the aperture and projecting outward from the top of the upper hemisphere 60. The base portion 66 illustrated is approximately shaped like a hollow cylinder, however other shapes are possible.

The lower hemisphere 62, as illustrated includes an inner circumferential inset 68 the couples and joins with the interior circumference of the upper hemisphere 60 to form the hollow gradient diffusion globe 22. The joining can be accomplished by adhesive, ultrasonic welding, or by snap fitting. A retaining ring 52 includes an interior aperture 72. Referring to FIGS. 6 and 8, the interior aperture 72 is configured to secure the base portion 66 of the hollow gradient diffusion globe 22 to the planar reflective sheet 24 of FIG. 2. In one embodiment, the outer circumference of the base portion 66 passes through the aperture 48 of the planar reflective sheet 24. The diffusion globe 22 is secured to the planar reflective sheet 24 by the retaining ring 52. The outer circumference of the base portion 66 fits snuggly into the interior aperture 72 of the retaining ring 52. The base portion 66 and retaining ring 52 can be secured by adhesive. The planar reflective sheet 24 is sandwiched between the diffusion globe 22 and the retaining ring 52.

In an alternative embodiment for securing the diffusion globe 22 to the planar reflective sheet 24, the interior aperture 72 of the retaining ring 52 and the outer circumference of the base portion 66 include complementary threading. The outer circumference of the base portion 66 passes through the aperture 48 of the planar reflective sheet 24. The outer circumference of the base portion 66 and the interior aperture 72 of the retaining ring 52 screws securely together. The planar reflective sheet 24 is sandwiched between the diffusion globe 22 and retaining ring 52.

Figure 9:
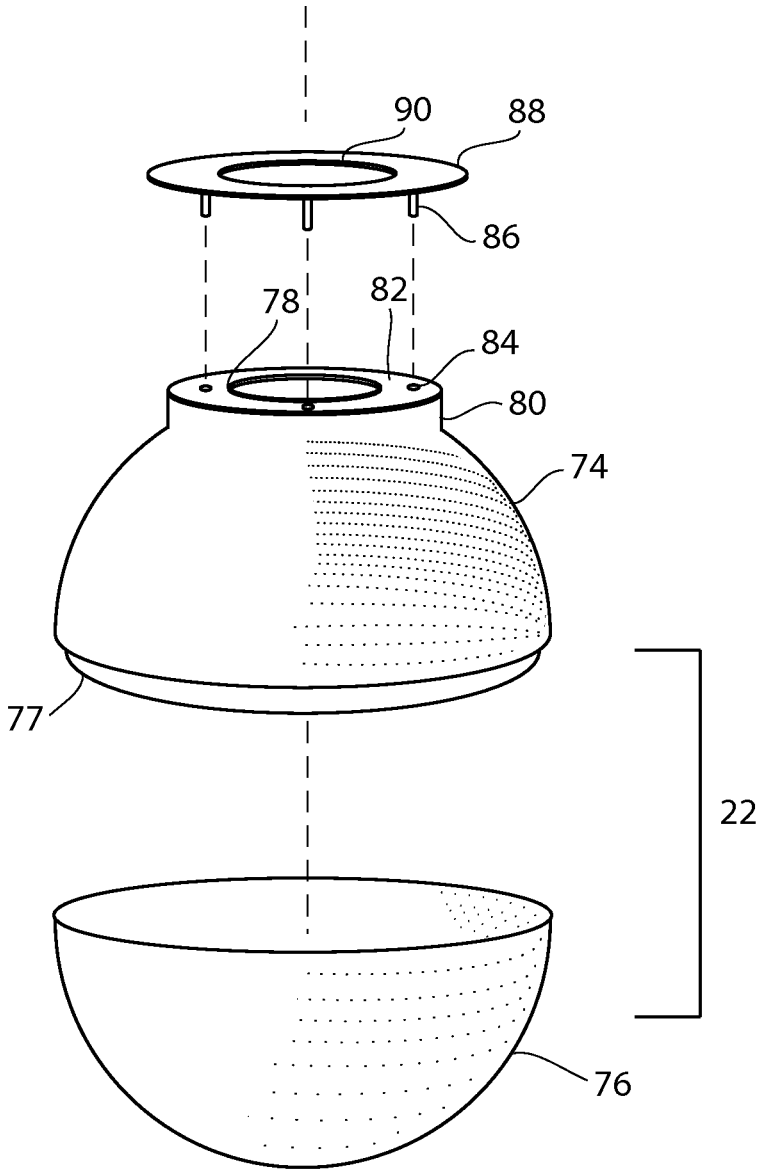
FIG. 9 depicts an alternative embodiment of a globe diffuser and ring assembly in accordance with principles of the invention.

FIG. 9 depicts an alternative embodiment of the hollow gradient diffusion globe 22 and ring assembly in accordance with principles of the invention shown in a top perspective view. As in FIG. 8, in order to help facilitate manufacturing of the diffusion globe, for example by injection molding, the hollow gradient diffusion globe 22 can be molded, or otherwise formed in two hemispheres: an upper hemisphere 74 and a lower hemisphere 76. The upper hemisphere 74 includes an inner circumferential inset 77 that can couple and join with the interior circumference of the lower hemisphere 76 to form the hollow gradient diffusion globe 22. The joining can be accomplished by adhesive, ultrasonic welding, or by snap fitting as previously described.

The upper hemisphere 74 includes an aperture 78 and a base portion 80 surrounding the aperture 78 and projecting outward from the top of the upper hemisphere 74. The base portion 80 includes an upper planar surface 82 that includes a plurality of holes 84. The holes 84 are sized and positioned to receive corresponding projections 86 projecting outward from a retaining ring 88. The retaining ring 88 includes an interior aperture 90. The outer circumference of the base portion 80 passes through the aperture 48 of the planar reflective sheet 24 of FIG. 2. The planar reflective sheet 24 of FIG. 2, for the this embodiment, can include a plurality of holes positioned and sized to line up with the plurality of holes 84 of the planar reflective sheet 24 of the base portion 80. The outer circumference of the base portion 80 and the interior aperture 90 of the retaining ring 88 fit snuggly together and can be secured by adhesive; the planar reflective sheet 24 sandwiched between them. Alternatively, the projections 86 can snap fit into the holes 84 enabling the hollow gradient diffusion globe 22 to secure to the planar reflective sheet 24 of FIG. 2, without adhesive.

Figure 10:
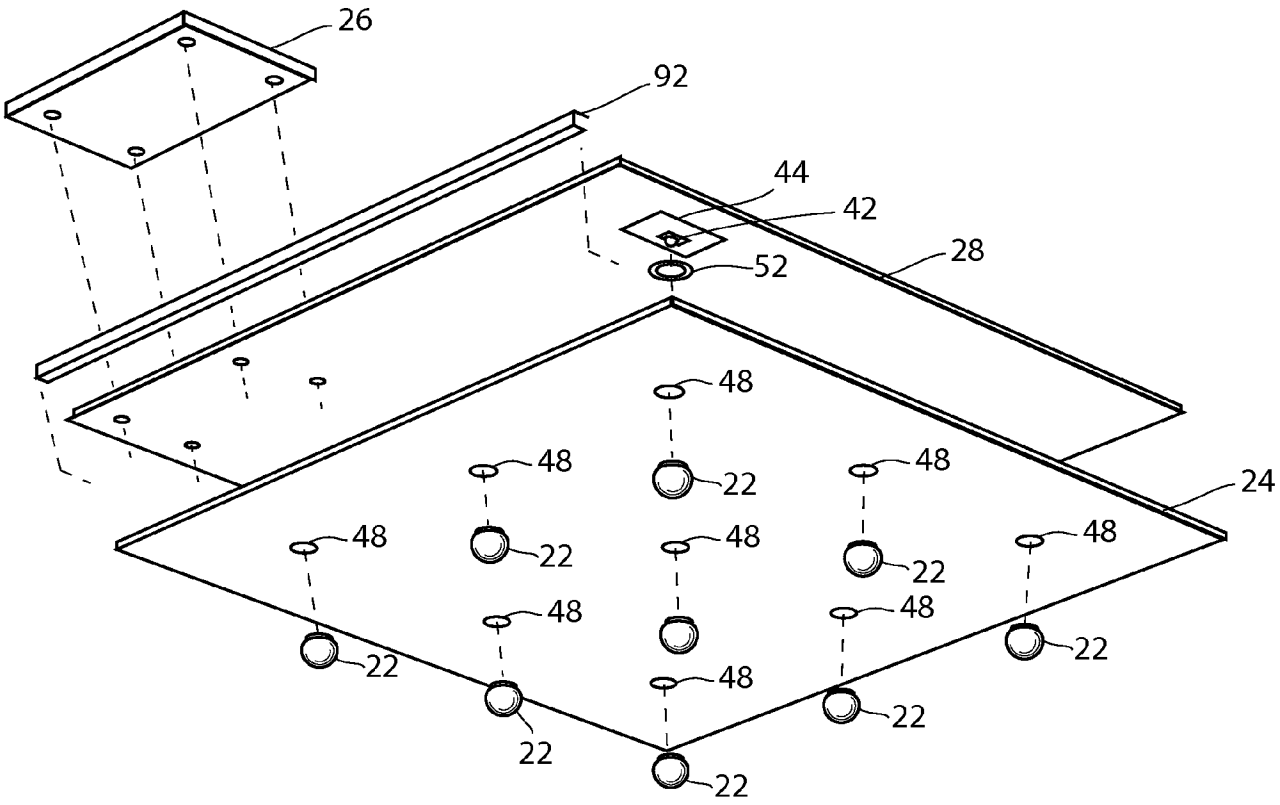
FIG. 10 depicts a bottom perspective exploded view of the light fixture of FIG. 2.
Figure 11:
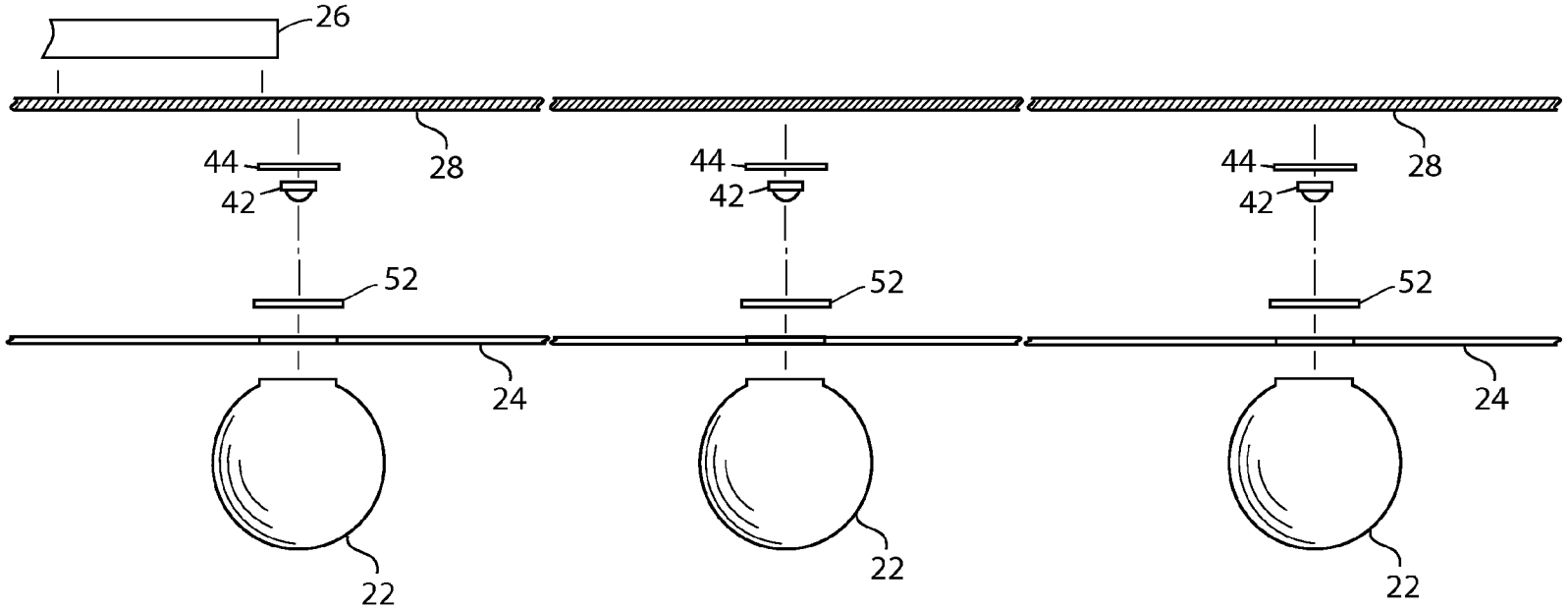
FIG. 11 depicts a front exploded view of the lighting fixture of FIG. 10.

FIG. 10 depicts a bottom perspective exploded view of the light fixture of FIG. 2. FIG. 11 depicts a front exploded view of the lighting fixture of FIG. 2. FIGS. 10 and 11 depict a plurality of the hollow gradient diffusion globes 22, the planar reflective sheet 24 with the corresponding plurality of apertures 48, and retaining ring 52 for securing a corresponding hollow gradient diffusion globe 22 to the planar reflective sheet 24. In addition, illustrated is one of the LED clusters 42 mounted on one of the PCBs 44. The PCB 44 is mounted and secured to the backplane 28. The PCB 44 can secure to the backplane 28, for example, by screwing or by a snap fit arrangement. The power and electronics assembly 26 is shown mounted to the backplane 28. The backplane 28 can act as a heatsink surface for both the LED clusters 42 and the power and electronics assembly 26.

In one embodiment, the planar reflective sheet 24 and backplane 28 can be joined together by a mounting frame 92, a portion of which is shown in FIG. 10. Alternative, the planar reflective sheet 24 and the backplane 28 can be joined directly by threaded fasteners through the surface of the planar reflective sheet 24 into the corresponding threads or threaded inserts, such as PEMs, on the backplane 28.

Figure 12:
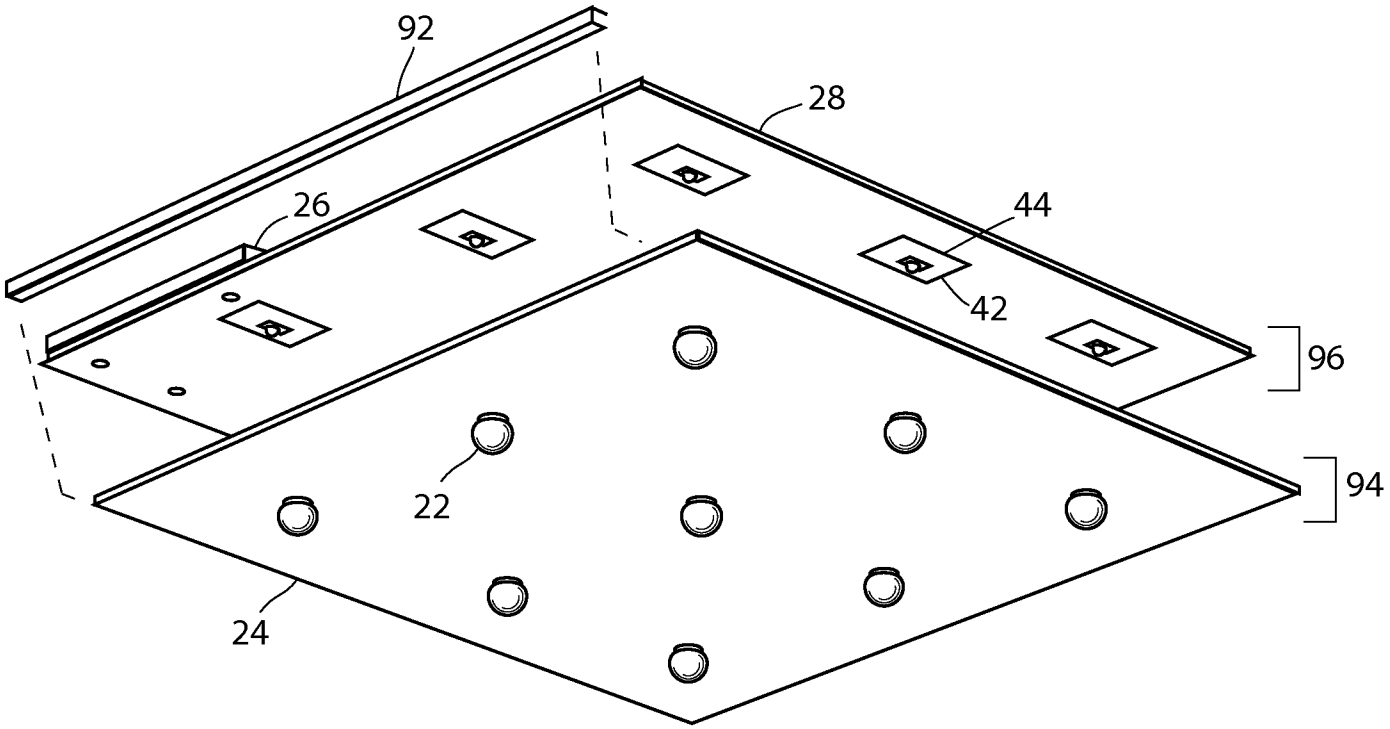
FIG. 12 depicts an exploded partial assembled perspective view of FIG. 2 showing an integrated reflective sheet and diffuser assembly.
Figure 13:
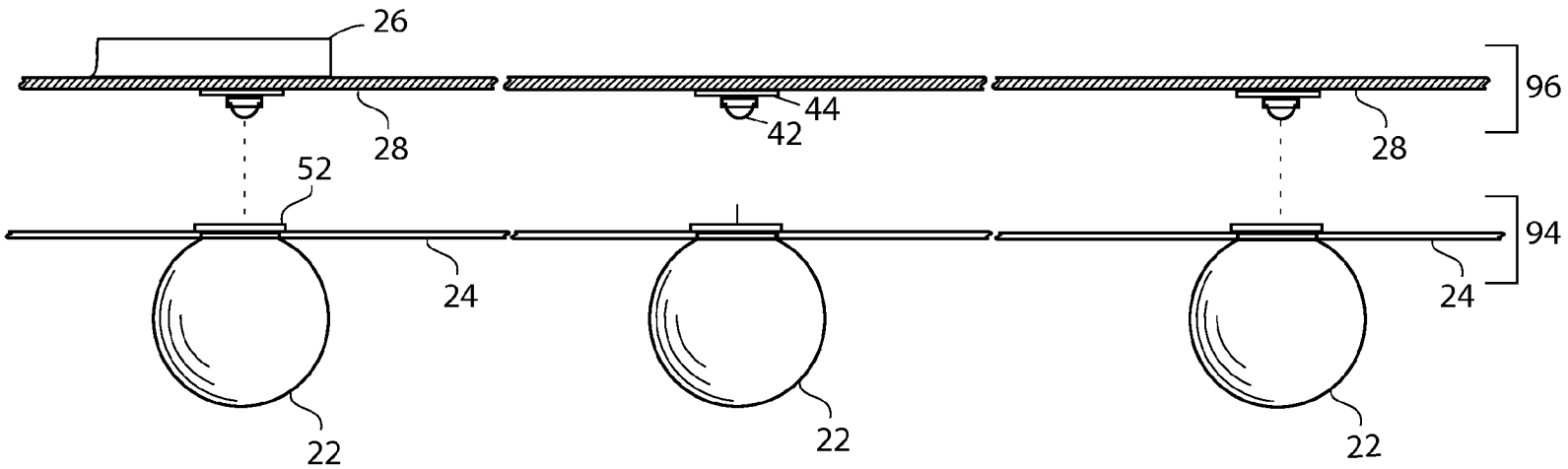
FIG. 13 depicts an exploded partial assembled front view of FIG. 12 showing an integrated reflective sheet and diffuser assembly.

FIG. 12 depicts an exploded partial assembled perspective view of FIG. 2 showing an integrated reflective sheet and diffusion globe assembly. FIG. 13 depicts an exploded partial assembled front view of FIG. 12. Referring to FIGS. 12 and 13, the plurality of retaining rings 52, the plurality of hollow gradient diffusion globes 22, and the planar reflective sheet 24 forms a first assembly 94. The backplane 28, the power and electronics assembly 26, plurality of PCBs 44, and corresponding plurality of LED clusters 42, forms a second assembly 96. The first assembly 94 forms an outer illumination surface for the second assembly 96. The second assembly 96 forms the active light-generating portion. This arrangement allows for easy servicing. The first assembly 94, or cover portion, can be removed easily and as an integrated assembly from the second assembly 96, or active light-generating portion. In one embodiment, the first assembly 94 can be removed from the second assembly 96 by simply removing the mounting frame 92, a portion of which is shown. Alternatively, the first assembly 94 can be removed from the second assembly 96 by removing fasteners from the surface of the planar reflective sheet 24.

Figure 14:
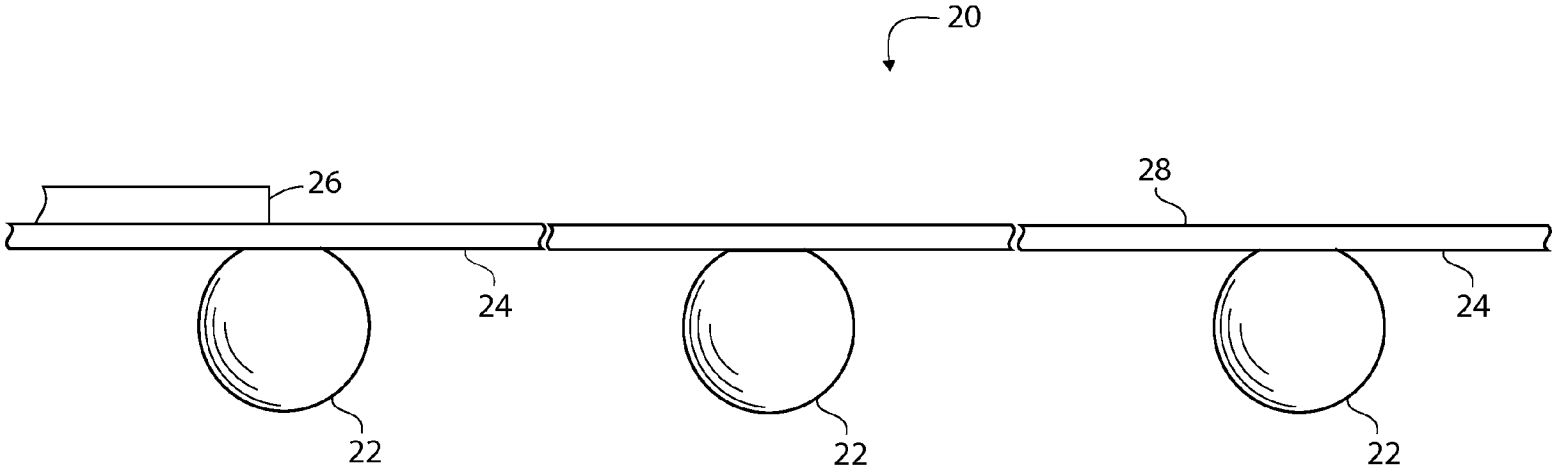
FIG. 14 depicts a front assembled view of the light fixture of FIG. 2.

FIG. 14 depicts a front assembled view of the LED lighting fixture 20 of FIG. 2. Depicted in FIG. 14 are the hollow gradient diffusion globes 22, the power and electronics assembly 26, a side view of the mounting frame 92 encompassing the backplane 28 and planar reflective sheet 24. The edge of backplane 28 and the edge of the planar reflective sheet 24 are both shown.

Figure 15:
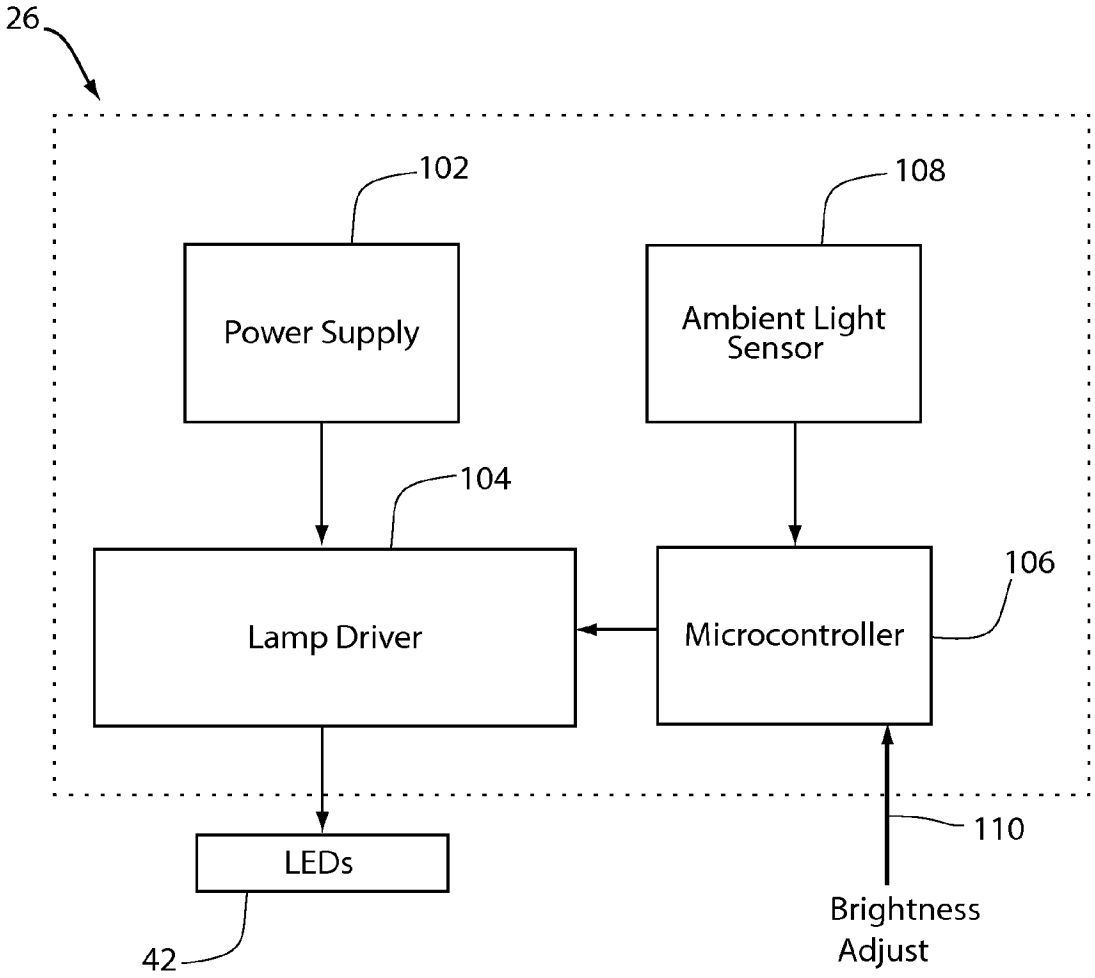
FIG. 15 depicts an electrical block diagram in one embodiment of the disclosed lighting fixture.

FIG. 15 depicts an electrical block diagram in one embodiment of the disclosed lighting fixture. The electronics can be encompassed within the power and electronics assembly 26 of FIG. 2. The electronics include a power supply 102, an LED driver 104, a microcontroller 106, and can include an ambient light sensor 108. The LED driver 104 and the microcontroller 106 can be separate devices, or an integrated device. A field programmable logic array (FPGA) or other programmable logic device (PLD) can be used instead of the LED driver 104 and the microcontroller 106. In any of the above combinations, the LED driver 104 be include power driver devices, such as n-channel or p-channel mosfets or can be used in combination with external n-channel or p-channel mosfets. For example, the LED driver 104 can include a combination of an LM3904HV p-channel mosfet buck controller with p-channel mosfets suitable to drive the LED clusters 42, such as SI2337DS. This design would be capable of receiving distributed power from DC voltage. Alternatively, the LED driver 104 can include an LM3464 capable of receiving 120 VAC and suitable for driving the LED clusters 42 in combination with mosfet transistors such as FDD2572.

The microcontroller 106 can be capable of processing and acting on signals external signals such as brightness adjust signal 110 or a signal from the ambient light sensor 108 capable of measuring the ambient light in room. The microcontroller 106 can be disposed to act on these signals and signal the lamp controller to adjust the brightness of the LED clusters 42.

Figure 16:
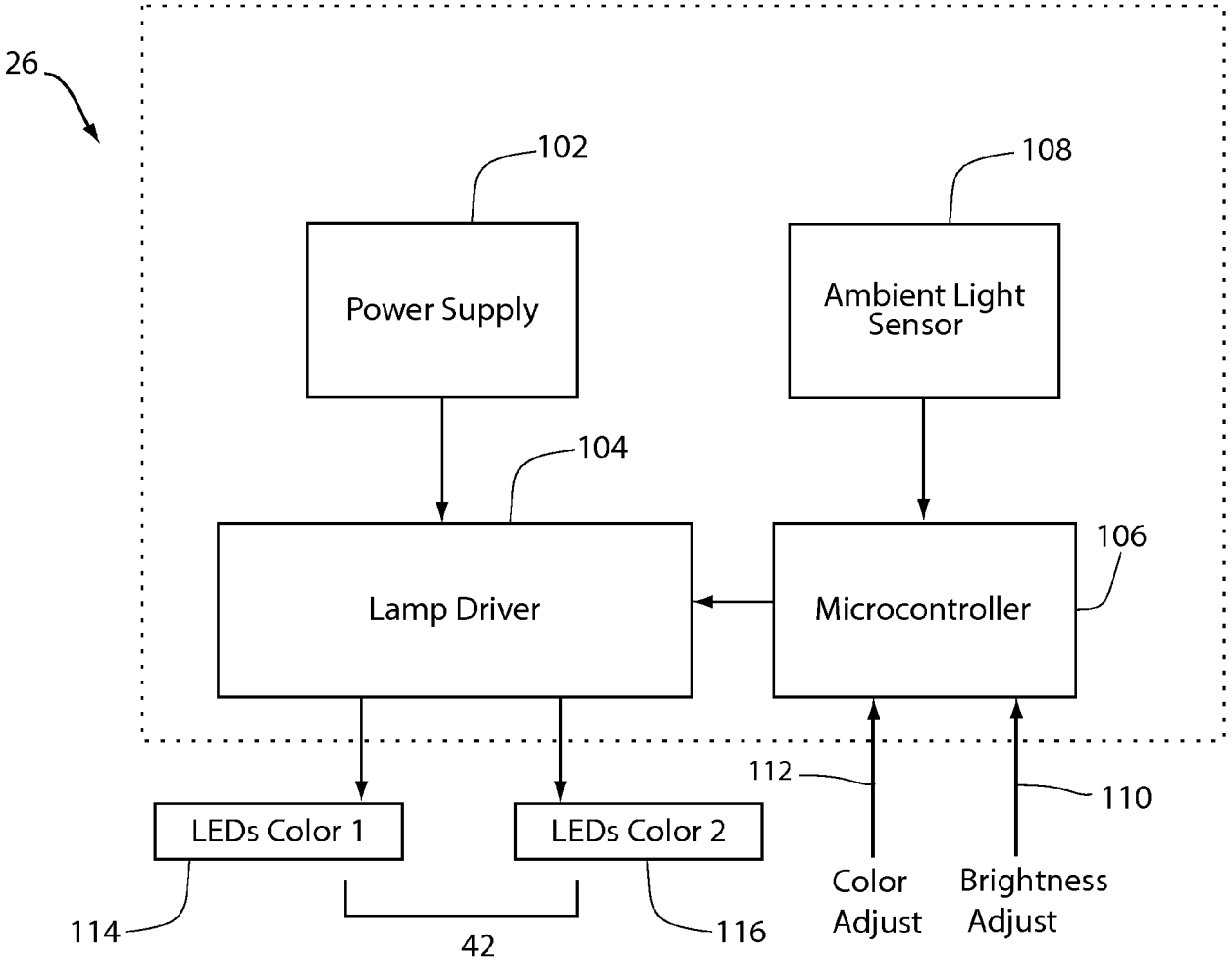
FIG. 16 depicts an alternative electrical block diagram in one embodiment of the disclosed lighting fixture.

FIG. 16 depicts an alternative electrical block diagram in one embodiment of the disclosed lighting fixture. FIG. 16 depicts the power supply 102, LED driver 104, microcontroller 106, ambient light sensor 108, and brightness adjust 110 as previously described for FIG. 15. In FIG. 16, the system is able to adjust the color temperature of the LED lighting fixture 20 of FIG. 2. Each LED cluster 42 in FIG. 16 includes a first LED 114 and a second LED 116. The first LED 114 and second LED 116 have different color temperature outputs. Based on factors such as time of day, ambient light conditions determined by the ambient light sensor 108, or manual color adjustment 112, the microcontroller 106 can signal the LED driver 104 to adjust the current output to the first LED 114 and second LED 116 of each LED cluster 42 in order to obtain a desired color balance.

Figure 17:
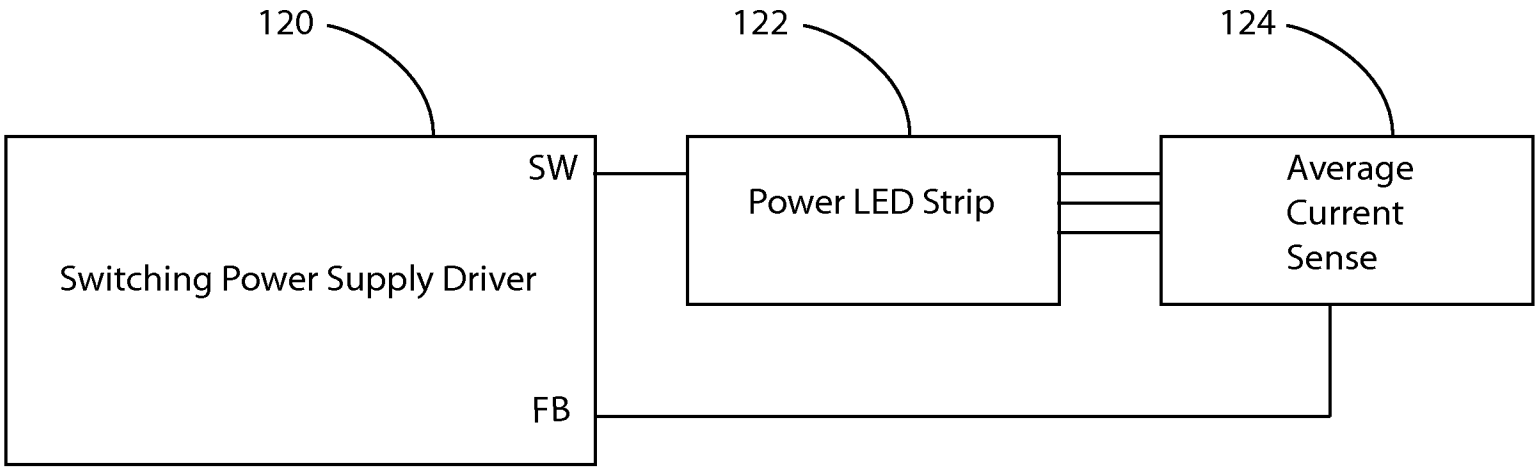
FIG. 17 depicts an electrical block diagram of an LED drive circuit in one embodiment of the disclosed lighting fixture.

FIG. 17 depicts a simplified electrical block diagram of an LED drive circuit in one embodiment of the disclosed lighting fixture. In FIG. 17 a switching power supply 120 that can be enclosed within the power and electronics assembly 26, supplies power to the LED clusters 42 that can be connected in strips 122. Average current is sensed by an average current sensing circuit 124 and feedback to the switching power supply 120.

Figure 18:
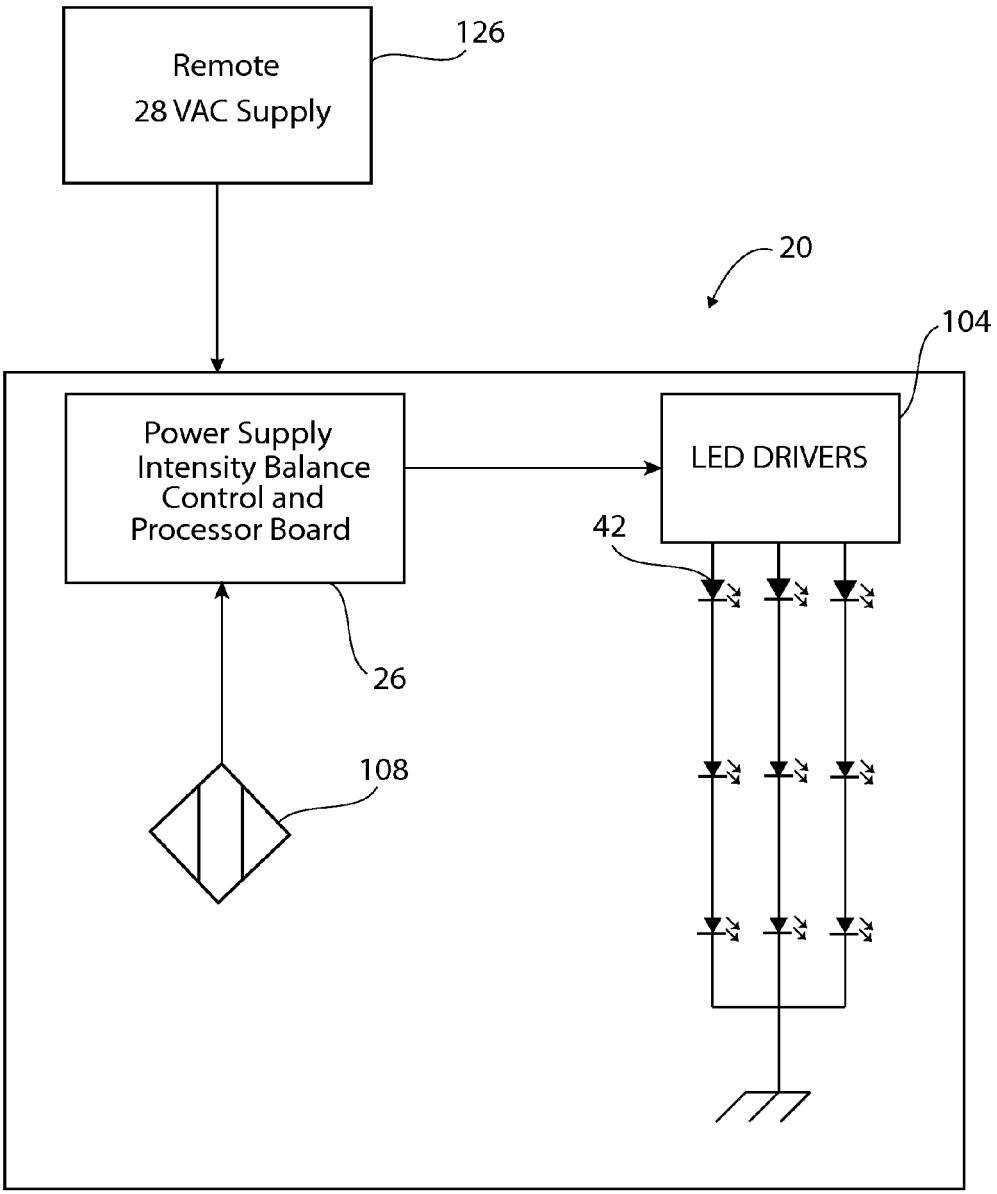
FIG. 18 depicts an electrical block diagram with a low voltage power distribution.
Figure 19:
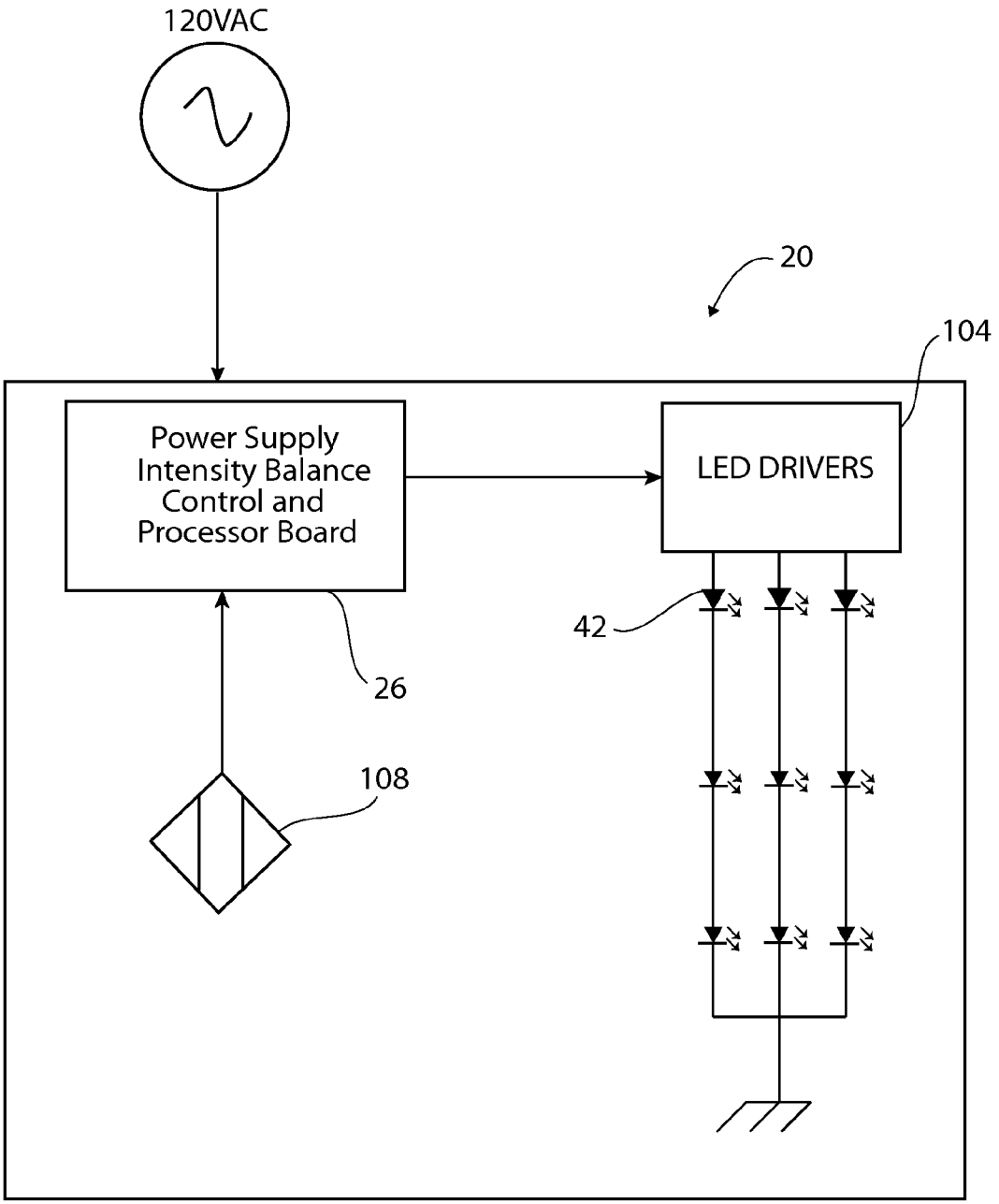
FIG. 19 depicts an electrical block diagram with AC supplied power distribution.

FIG. 18 depicts a system level diagram of LED lighting fixture 20 with a low voltage power distribution. FIG. 19 depicts a similar system level diagram of LED lighting fixture 20 with AC supplied power distribution. Referring to FIGS. 18 and 19, the power and electronics assembly 26 receives externally supplied power. In FIG. 18, the power is received from distributed low voltage AC power, for example, 24-28 VAC depicted by the remote power block 126. In many jurisdictions, lighting systems using low voltage distributed power as described can be wired without the need of a licensed electrician. In FIG. 19, the power is received from commercial or residential line voltage; in the U.S. this is typically 120 VAC. The power and electronics assembly 26 supplies the required current to LED drivers 104. In FIGS. 18 and 19, the LED drivers 104 are depicted diagrammatically external from the power and electronics assembly 26. As previously described, however, the LED drivers 104 can be included within the power and electronics assembly 26. The LED driver 104 supplies each LED cluster 42. Depicted in both FIGS. 18 and 19 are nine of the LED clusters 42 as shown in FIG. 9. It should be understood that this quantity could be modified as required by the application. While each LED cluster 42 is represented by a single LED, this is only for the sake of diagrammatic simplicity.

Also depicted in FIGS. 18 and 19 is an ambient light sensor 108 as previously described. The ambient light sensor 108 can be integrated into the surface of power and electronics assembly 26 facing the backplane 28 of FIG. 2. Both the backplane 28 and the planar reflective sheet 24 of FIG. 2 can each include an aperture aligned and sized to receive the ambient light sensor 108 through outer illumination surface of the light fixture.

Figure 20:
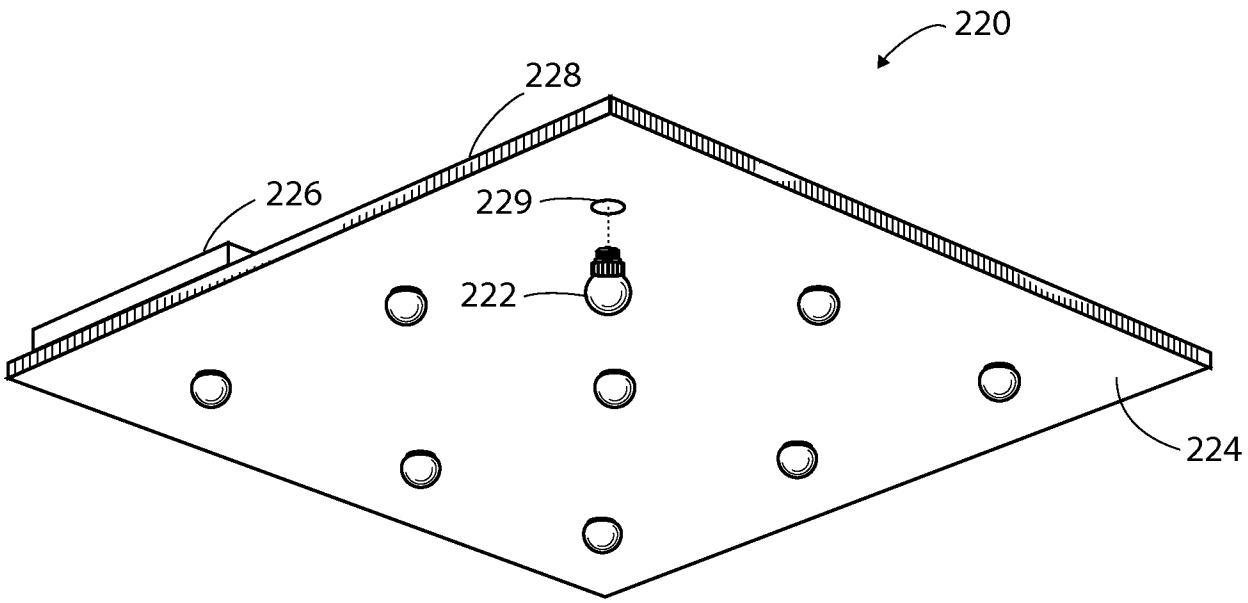
FIG. 20 depicts an alternative embodiment of an LED lighting system in accordance with principles of the invention in front perspective view.

FIG. 20 depicts an alternative embodiment of an LED lighting fixture 220 in accordance with principles of the invention in front perspective view. FIG. 20 depicts an LED lamp 222, a planar reflective sheet 224, a power and electronics assembly 226, and a backplane 228. The planar reflective sheet 224 forms an outer illumination surface of the LED lighting fixture 220. The planar reflective sheet 224 includes a plurality of apertures 229. Each aperture 229 is sized and shaped to receive a portion of a corresponding LED lamp 222. The power and electronics assembly 226 supplies power to the LEDs. The power and electronics assembly 226 can include a DC-to-DC power supply capable of receiving distributed DC voltage into the light fixture. In an alternative embodiment, the power and electronics assembly 226 can include an AC-to-DC power supply capable of receiving standard line voltage, for example 120 VAC in the United States, from a commercial or residential branch circuit and converting it to the DC supply voltage capable of powering the LED clusters 242. The power and electronics assembly 226 can be affixed to the backplane 228. The backplane 228 forms a bottom outer surface of the light fixture. The backplane 228 can be used as continuous planar heatsink to dissipate the heat from the LED lamps 222 and can dissipate heat generated by the power and electronics assembly 226.

Figure 21:
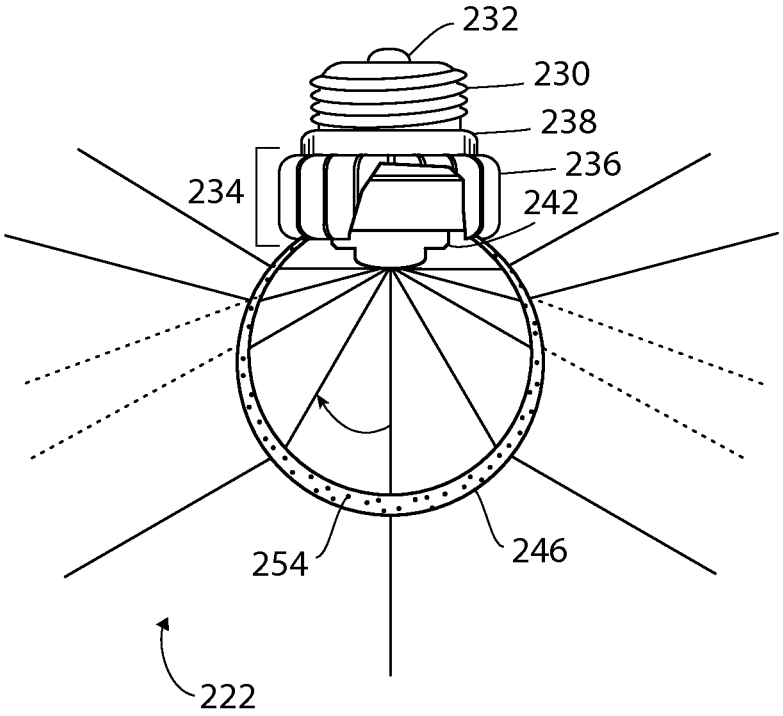
FIG. 21 depicts a removable LED lamp of FIG. 20 in partial cutaway view.

FIG. 21 depicts an LED lamp 222 of FIG. 20 in partial cutaway view. The lamp can be an Edison screw-in or plug-in type such as double contact bayonet type. Depicted is a lamp that is screw-in type with a threaded cap 230 and electrical contact 232. In one embodiment, the threaded cap 230 and electrical contact 232 can be standard screw base, for example, Edison screw base E10, E14, or E26. Coupled to the threaded cap 230 is a base portion 234 that can include a finned heat sink 236 and a pedestal 238. The base portion 234 is thermally coupled to the LED cluster 242. The LED lamp 222 includes a hollow cover portion 246. The cover portion is constructed in a similar manner as is described for the hollow cover portion 46 of FIG. 6.

The hollow cover portion 246 includes wall bound by the exterior surface of the hollow cover portion 246. The exterior surface of the wall has the shape of a globe. The hollow cover portion 246 can be injection molded or otherwise formed from a semi-transparent or translucent plastic material such as ABS, acrylic plastic, polycarbonate, or PVC. A diffusing-particulate 254 is homogenously distributed within the wall. The particulate is made of a material that has a light scattering effect when encapsulated within clear or translucent plastic, for example Titanium Dioxide, Zinc Oxide, or metallic particulates. A continuously graduated diffusive wall is created by the combination of diffusing-particulate 254 homogenously distributed within the wall, and by smoothly and continuously varying the thickness of the wall.

The wall bounding the interior surface has approximately the same shape as the wall bounding the exterior surface but with a smaller radius. The interior surface is approximately axial to and non-concentric with the exterior surface. This arrangement creates a wall thickness that is thickest opposite the LED cluster 242, progressively and smoothly thinning where the thinnest portions are adjacent to the LED cluster 242. The great amount of diffusion and most random internal reflection take place where the wall is thickest since there is the most diffusing particulate. The least amount of diffusion and least internal reflection take place where the wall is the thinnest. With this arrangement, harsh direct light from the LED cluster 242 is attenuated and the overall illumination across can be made to be equal across the entire lighting fixture illumination surface.

Continuing to refer to FIG. 21, an illustrative ray trace diagram shows a typical light pattern emanating from the LED cluster 242. A portion of the rays are diffused externally with respect to the hollow cover portion 246 and are represented by rays normal to the hollow cover portion 246. Some of the rays are refracted and are illustrated by broken lines. Some of the rays are internally reflected by not shown for simplicity. Greater amounts of internal reflection come from the regions of greatest diffusion as compared with areas of less diffusion. For example, greater amount of internal reflection would occur where the wall of the hollow cover portion 246 is the thickest near the top of the globe, opposite the LED cluster 242 as compared to portions of hollow cover portion 246 adjacent to the LED. The area of greatest refraction, least diffusion, and least internal reflection occur where the wall of the hollow cover portion 246 is the thinnest which is adjacent to the LED cluster 242.

The arrangement, shape and size of the inner wall with respect to the outer wall of the hollow cover portion 246 depicted in FIG. 21 can potentially create an approximately complementary light emission pattern as the relative intensity pattern of FIG. 1. The arrangement, shape and size of the inner wall with respect to the outer wall of the hollow cover portion 246 in combination with internal reflection and diffusion within the hollow cover portion 246 creates the appearance of even lighting across the hollow cover portion 246 of the LED lamp 222. This in combination with the ray emission pattern from the hollow cover portion 246, the reflection from the planar reflective sheet 24, and the spacing between the LED lamps 222, create the appearance of uniform lighting across the entire an outer illumination surface of the light fixture.

Figure 22:
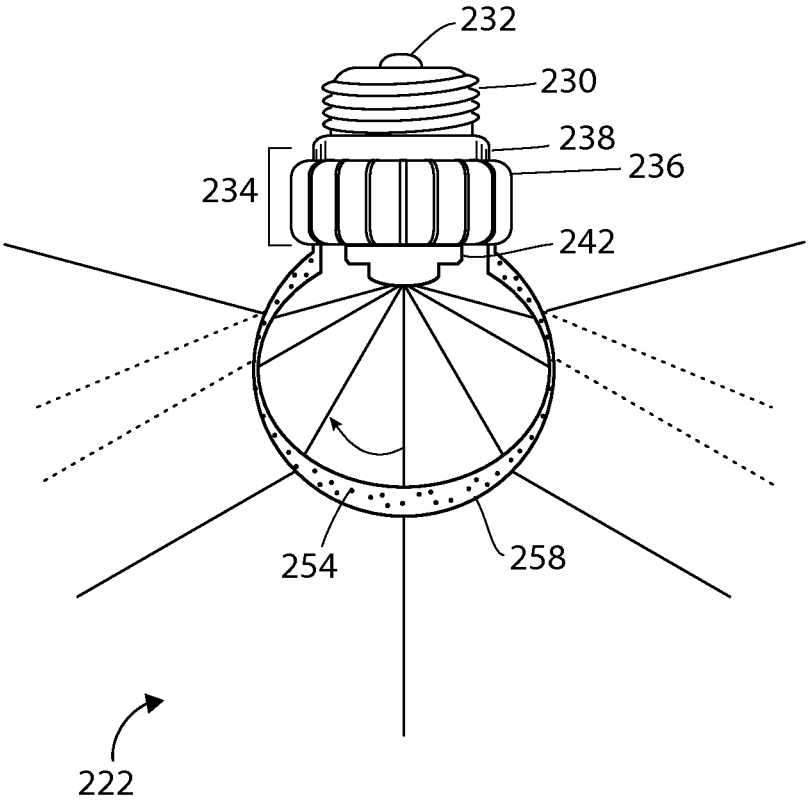
FIG. 22 depicts and alternative embodiment of a removable LED lamp of FIG. 20 in partial cutaway view.

FIG. 22 depicts an alternative embodiment of an LED lamp 222 of FIG. 20 in partial cutaway view. The LED lamp 222 of FIG. 22 includes threaded cap 230, electrical contact 232, base portion 234, finned heat sink 236, pedestal 238, LED cluster 242, and the diffusing-particulate 254 as described in FIG. 21. The hollow cover portion 258 is configured similar to the hollow cover portion 58 of FIG. 7.

In FIG. 22, the hollow cover portion 258 includes wall bound by the exterior surface of the hollow cover portion 258. The exterior surface of the wall has the shape of a sphere. The diffusing-particulate 254 is homogenously distributed within the wall as previously described. The particulate is made of a material that has a light scattering effect when encapsulated within clear or translucent plastic, as previously described. The wall bounding the interior surface has is an oblate spheroid. The interior surface is approximately axial to and non-concentric with the exterior surface. This arrangement creates a wall thickness that is thickest opposite the LED cluster 242, progressively and smoothly thinning where the thinnest portion along the circumference between the upper and lower hemisphere of the hollow cover portion 258. The great amount of diffusion and most random internal reflection take place where the wall is thickest since there is the most diffusing particulate. The least amount of diffusion and least internal reflection take place where the wall is the thinnest. With this arrangement, harsh direct light from the LED cluster 242 is attenuated. The overall illumination across can be made to be equal across the entire lighting fixture illumination surface with the relative distance between each LED lamp 222 being further than with the LED lamps 222 of FIG. 21.

Figure 23:
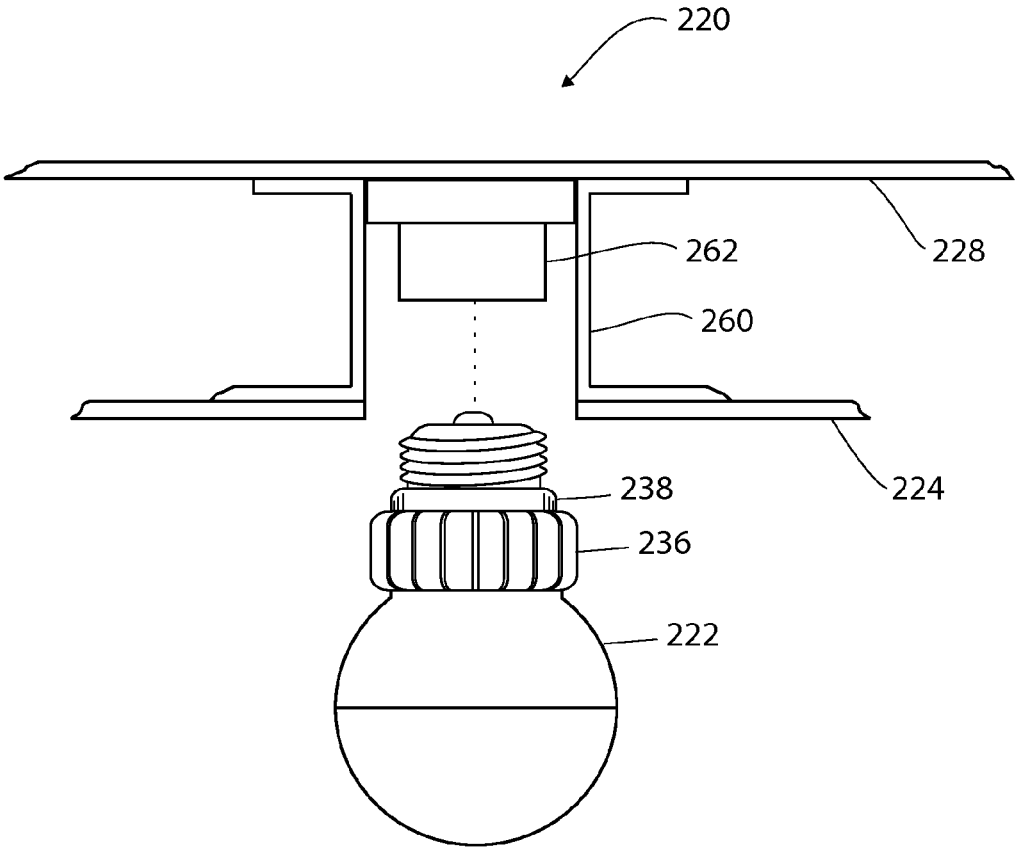
FIG. 23 depicts a portion of the LED lighting system of FIG. 20, in partial cutaway view.
Figure 24:
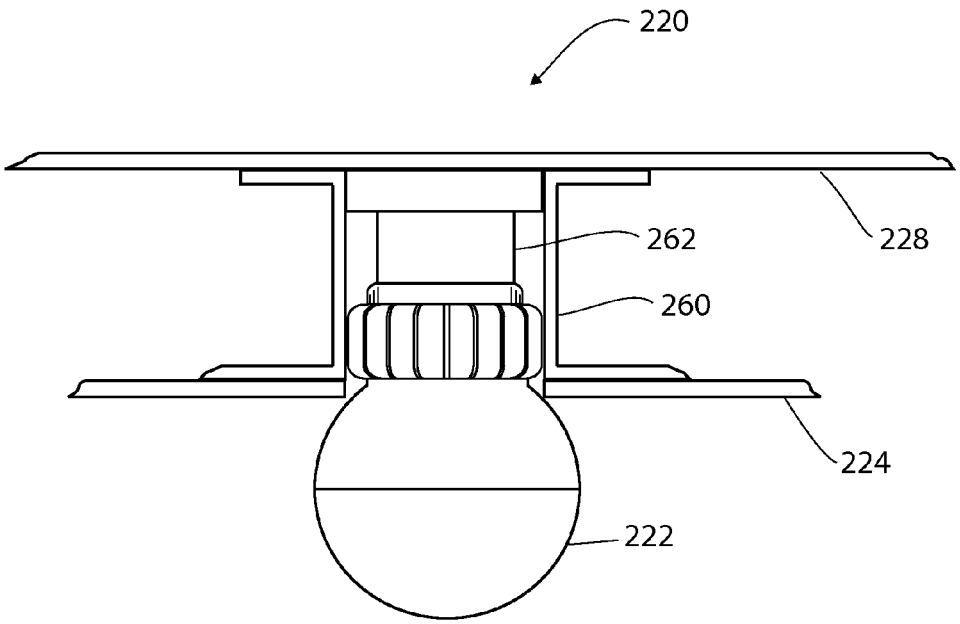
FIG. 24 depicts an alternative view of the portion of the LED lighting system of FIG. 20.

FIG. 23 depicts a portion of the LED lighting fixture 220 of FIG. 20 in partial cutaway view with the LED lamp 222 separated from the structure of the LED lighting fixture 220. FIG. 24 depicts an alternative view of the portion of the LED lighting fixture 220 of FIG. 23 with the LED lamp 222 electrically and mechanically secured to the socket. Referring to FIGS. 22 and 23, a hollow flange 260 spaces the backplane 228 from the planar reflective sheet 224. The flange may have apertures along its sidewall to allow air to circulate around the finned heat sink 236. Within the aperture of the hollow flange 260 is a lamp socket 262. The lamp socket 262 is disposed to receive the threaded cap 230 and the electrical contact 232. For example, the lamp socket 262 can be an Edison type E26 base for receiving an E26 cap. The lamp socket 262 can be configured with a heat-conducting portion that thermally couples to the pedestal 238 of the LED lamp 222. For example, both the pedestal 238 and lamp socket 262 can include complementary parallel surfaces disposed to act as an efficient heat-conducting interface. The pedestal 238 can be thermally coupled to the backplane 228 so that the pedestal 238 is thermally coupled to the backplane 228.

An apparatus (method, device, machine, etc.) has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that the scope of the claimed invention is defined solely by the following claims and their equivalents.

What is claimed is:

1. An LED lighting fixture, comprising:

(a) a front cover assembly of the LED lighting fixture comprising:

a plurality of hollow diffusion globes;

a planar reflective sheet, including a plurality of apertures arranged in a grid pattern;

each hollow diffusion globe of the plurality of hollow diffusion globes is secured to the planar reflective sheet into a corresponding aperture of the plurality of apertures; and the plurality of hollow diffusion globes and the planar reflective sheet, in combination, forming a front outside surface of the LED lighting fixture;

each hollow diffusion globe comprises a wall bound by an exterior surface having a shape of a globe, a wall of varying thickness with a thickest wall portion facing opposite the corresponding aperture of the plurality of apertures, a diffusing-particulate homogenously distributed within the wall, and the wall and the diffusing-particulate in combination form a continuously graduated diffusive surface;

(b) a backplane assembly comprising:

a planar heatsink, including opposing front and back planar surfaces, the back planar surface forming a back outside surface of the LED lighting fixture;

a plurality of LED clusters arranged in the grid pattern corresponding to the plurality of apertures, the plurality of LED clusters thermally coupled to the planar heatsink; and the front cover assembly is wholly removably securable to the backplane assembly.

2. The LED lighting fixture of claim 1 wherein:

the plurality of apertures are so arranged so that the planar reflective sheet and plurality of diffusion globes in combination form an even illumination surface.

* * * * *